US012370430B2

(12) United States Patent
Mackey et al.

(10) Patent No.: US 12,370,430 B2
(45) Date of Patent: Jul. 29, 2025

(54) ATHLETIC GEAR WITH A PRINTED COVER

(71) Applicant: BAUER HOCKEY CORP., Blainville (CA)

(72) Inventors: Lee Mackey, Prevost (CA); Pascal Martel, Montreal (CA)

(73) Assignee: BAUER HOCKEY LLC, Exeter, NH (US)

( * ) Notice: Subject to any disclaimer, the term of this patent is extended or adjusted under 35 U.S.C. 154(b) by 218 days.

(21) Appl. No.: 14/820,016

(22) Filed: Aug. 6, 2015

(65) Prior Publication Data

US 2016/0038821 A1 Feb. 11, 2016

Related U.S. Application Data

(60) Provisional application No. 62/033,770, filed on Aug. 6, 2014.

(51) Int. Cl.

| | |
|---|---|
| ***A63B 71/08*** | (2006.01) |
| ***A43B 1/00*** | (2006.01) |
| ***A43B 5/16*** | (2006.01) |
| ***A63B 71/12*** | (2006.01) |
| ***A63B 71/14*** | (2006.01) |
| *A63B 71/06* | (2006.01) |

(52) U.S. Cl.

CPC ..... *A63B 71/08* (2013.01); *A43B 1/0072* (2013.01); *A43B 5/16* (2013.01); *A43B 5/1666* (2013.01); *A63B 71/12* (2013.01); *A63B 71/1225* (2013.01); *A63B 71/143* (2013.01); *A63B 2071/0694* (2013.01); *A63B 2071/1208* (2013.01); *A63B 2209/00* (2013.01)

(58) Field of Classification Search

CPC ..... A63B 71/08; A63B 71/12; A63B 71/1225; A63B 71/1233; A63B 71/1241

See application file for complete search history.

(56) References Cited

U.S. PATENT DOCUMENTS

| | | | | | |
|---|---|---|---|---|---|
| 4,342,801 | A * | 8/1982 | Gerlach | D04H 1/587 | 428/397 |
| 4,587,142 | A * | 5/1986 | Higuchi | D06N 3/0004 | 428/156 |
| 5,071,698 | A * | 12/1991 | Scheerder | A41D 31/005 | 442/11 |
| 5,168,576 | A * | 12/1992 | Krent | A41D 13/0156 | 2/16 |
| 5,586,888 | A * | 12/1996 | Webb | A43B 3/30 | 434/258 |
| 5,881,395 | A * | 3/1999 | Donzis | A41D 13/0153 | 2/24 |

(Continued)

OTHER PUBLICATIONS https://web.archive.org/web/20121128162505/http://www.inlinewarehouse.com/Tour_Evolution_6000_Goalie_Leg_Pads_Senior_/descpage-TE6LP.html (Year: 2012).*

(Continued)

*Primary Examiner* — Megan E Lynch

(57) ABSTRACT

An article of athletic gear, such as an article of protective athletic equipment (e.g., a leg pad, an arm pad, shoulder pads, a chest protector, or a protective glove), wearable by a user and comprising a core (e.g., comprising protective padding) and a cover that is disposed on the core and comprises synthetic material and a printed image (e.g., a digitally-printed image) on the synthetic material.

56 Claims, 29 Drawing Sheets

(56) References Cited

U.S. PATENT DOCUMENTS 6,065,152 A * 5/2000 Parker ..... A63B 71/1225 2/22
RE37,468 E * 12/2001 Kennedy ..... A63B 41/08 473/604
9,266,263 B1 * 2/2016 Jaeger ..... B29D 99/0067
2002/0020082 A1 * 2/2002 James ..... A43B 3/0078 36/112
2005/0124242 A1 * 6/2005 Norvell ..... A41D 31/02 442/76
2007/0250965 A1 * 10/2007 Sioul ..... A63B 71/1225 2/24
2007/0250982 A1 * 11/2007 Norman ..... A41D 27/08 2/69
2008/0120756 A1 * 5/2008 Shepherd ..... A41D 13/0543 2/22
2009/0035524 A1 * 2/2009 Wyner ..... A41D 13/082 428/156
2009/0186724 A1 * 7/2009 Ashida ..... A63B 41/08 473/607
2009/0314696 A1 * 12/2009 Trentacosta ..... A62B 17/006 210/97
2010/0009792 A1 * 1/2010 Ashida ..... A63B 41/08 473/607
2010/0192280 A1 * 8/2010 McClard ..... B41J 2/325 2/161.8
2012/0084896 A1 * 4/2012 Wyner ..... A63B 71/08 2/16
2012/0196104 A1 * 8/2012 Yeh ..... B32B 27/065 428/215
2012/0216327 A1 * 8/2012 Turner ..... A41D 13/0156 2/69
2012/0240303 A1 * 9/2012 Matta ..... A41D 13/065 2/24
2013/0025037 A1 * 1/2013 Turner ..... A41D 13/015 2/455
2013/0318675 A1 * 12/2013 Mackey ..... A63B 71/1225 2/22
2014/0259259 A1 * 9/2014 Smith ..... A63B 71/1225 2/22
2014/0259261 A1 * 9/2014 Mackey ..... A63B 71/1225 2/22
2014/0259399 A1 * 9/2014 Tsai ..... A63B 21/00105 5/420
2015/0159321 A1 * 6/2015 Hsin ..... D06N 3/14 427/373
2015/0354133 A1 * 12/2015 Yan ..... D06N 3/0097 156/247

OTHER PUBLICATIONS https://web.archive.org/web/20120604192626/http://www.inlinewarehouse.com/Mission_Soldier_SE_Goalie_Leg_Pads_Sr_11/descpage-MSLS.html (Year: 2012).*
https://www.youtube.com/watch?v=9A-Bis3DdpE (Year: 2010).*
Screenshot of boxing gloves sold on www.muaythaistuff.com (May 31, 2013), 2 pages.
Examiner Report issued on Sep. 22, 2021 in connection with Canadian Patent Application No. 2,899,795, 5 pages.

* cited by examiner

ATHLETIC GEAR WITH A PRINTED COVER

CROSS-REFERENCE TO RELATED APPLICATION

This application claims the benefit under 35 USC 119(e) of U.S. Provisional Patent Application 62/033,770 filed on Aug. 6, 2014 and hereby incorporated by reference herein.

FIELD OF THE INVENTION

The invention relates generally to athletic gear, such as protective athletic equipment (e.g., leg pads, goalkeeper blockers, shoulder pads, arm pads, chest protectors, protective gloves, etc.) and other articles of athletic gear, worn by individuals engaging in hockey, lacrosse, baseball, football, and other sports.

BACKGROUND

Individuals engaging in various sports, such as hockey, lacrosse, football, baseball, etc., typically wear athletic gear, including, for instance, protective athletic equipment (e.g., leg pads, shoulder pads, arm pads, gloves, helmets, etc.) to protect themselves against impacts with other people and/or objects (e.g., pucks, balls, sticks, playing surfaces, boards, etc.).

For example, hockey goalkeepers wear leg pads to protect their legs against impacts from pucks, balls, hockey sticks or other objects and/or to protect their legs when moving (e.g., dropping) them onto a playing surface, as well as a blocker on one of their hands to block shots by deflecting them away.

A hockey goalkeeper's leg pad or blocker typically comprises protective padding for providing padded protection and an outer cover disposed over the protective padding. The outer cover is exposed and thus usually serves to decorate the leg pad or blocker. For example, the outer cover may display a design including a color pattern, a logo, a word, etc. The outer cover is typically made of panels of synthetic pliable material such as synthetic leather (e.g., polyurethane (PU) leather) or fabric (e.g., nylon fabric, polyester fabric, Cordura™ fabric, etc.) that are cut into a desired configuration and sewn over the protective padding.

This type of outer cover of a hockey goalkeeper's leg pad or blocker has some drawbacks. For instance, it limits the design that can be displayed by the outer cover since elaborate designs may be too expensive or time-consuming to realize, if at all possible.

Outer covers of other articles of protective athletic equipment (e.g., shoulder pads, arm pads, chest protectors, protective gloves, etc.) worn by individuals engaging in hockey, lacrosse, baseball, football, and other sports may present similar drawbacks.

Other articles of athletic gear, which may not be used mainly or solely for protection, may also be limited in terms of design of their outer appearance. For instance, skates may be limited in design of their outer appearance due to certain constraints (e.g., materials, serigraphy limitations, etc.).

For these and other reasons, there is a need for improvements in athletic gear such as protective athletic equipment.

SUMMARY OF THE INVENTION

According to various aspects of the invention, there is provided an article of athletic gear (e.g., an article of protective athletic equipment, a skate, etc.) wearable by a user and comprising a core and a cover that is disposed on the core and comprises a synthetic material and a printed image (e.g., a digitally-printed image) on the synthetic material. This may provide significant freedom in designing an appearance of the article of athletic gear, notably as this may allow virtually any desired external design, even if very elaborate, to be efficiently imparted to the article of athletic gear.

For example, according to an aspect of the invention, there is provided an article of athletic gear wearable by a user. The article of athletic gear comprises a core and a cover disposed on the core. The cover comprises a synthetic material and a printed image on the synthetic material.

According to another aspect of the invention, there is provided an article of protective athletic equipment wearable by a user. The article of protective athletic equipment comprises protective padding and a cover disposed on the protective padding. The cover comprises synthetic material and a printed image on the synthetic material.

According to another aspect of the invention, there is provided a method of making a cover for an article of protective athletic equipment wearable by a user. The article of protective athletic equipment comprises protective padding. The cover is mountable on the protective padding. The method comprises providing synthetic material of the cover and printing an image on the synthetic material such that the cover includes a printed image.

According to another aspect of the invention, there is provided a leg pad for a hockey goalkeeper. The leg pad is wearable on a leg of the hockey goalkeeper to protect the leg. The leg pad comprises protective padding and an outer cover disposed on the protective padding. The outer cover comprises synthetic material and a printed image on the synthetic material.

According to another aspect of the invention, there is provided a blocking glove for a hockey goalkeeper. The blocking glove is wearable on a hand of the hockey goalkeeper to block a puck or ball. The blocking glove comprises protective padding and an outer cover disposed on the protective padding. The outer cover comprises synthetic material and a printed image on the synthetic material.

According to another aspect of the invention, there is provided a catching glove for a hockey goalkeeper. The catching glove is wearable on a hand of the hockey goalkeeper to catch a puck or ball. The catching glove comprises protective padding and an outer cover disposed on the protective padding. The outer cover comprises synthetic material and a printed image on the synthetic material.

According to another aspect of the invention, there is provided a skate wearable by a user. The skate comprises a core and a cover disposed on the core. The cover comprises a synthetic material and a printed image on the synthetic material.

These and other aspects of the invention will now become apparent to those of ordinary skill in the art upon review of the following description of embodiments of the invention in conjunction with the accompanying drawings.

BRIEF DESCRIPTION OF THE DRAWINGS

A detailed description of embodiments of the invention is provided below, by way of example only, with reference to the accompanying drawings, in which.

The description and drawings are only for the purpose of illustrating certain embodiments of the invention and are an aid for understanding. They are not intended to be a definition of the limits of the invention.

DETAILED DESCRIPTION OF EMBODIMENTS

Figure 1:
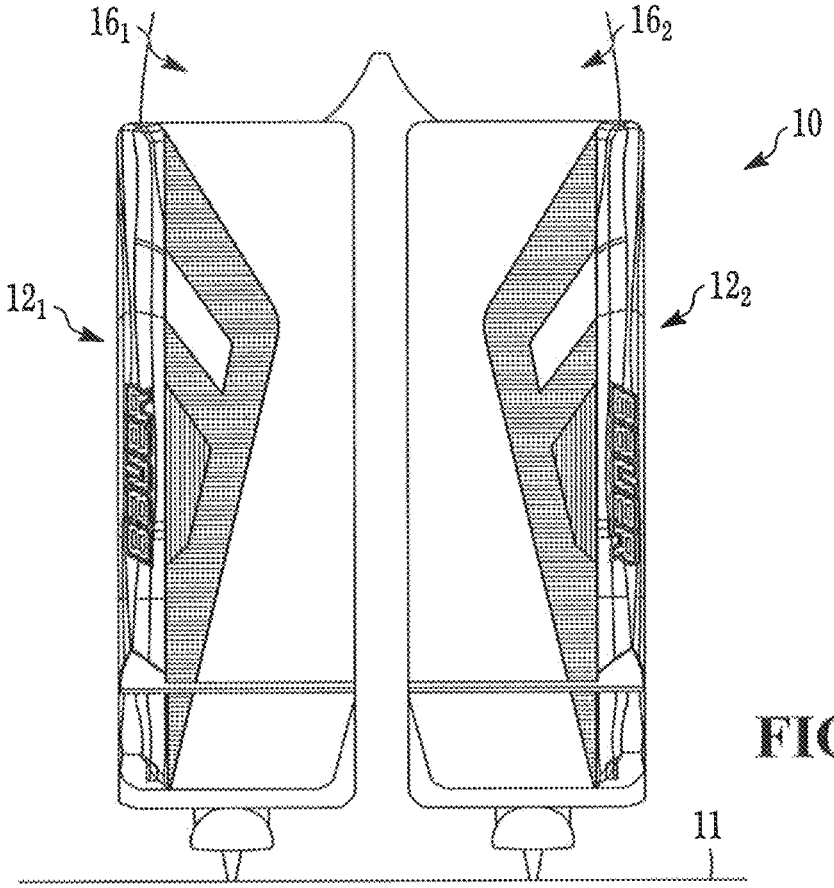
FIG. 1 shows a front view of an example of leg pads for protecting legs of a hockey goalkeeper in accordance with an embodiment of the invention.
Figure 2:
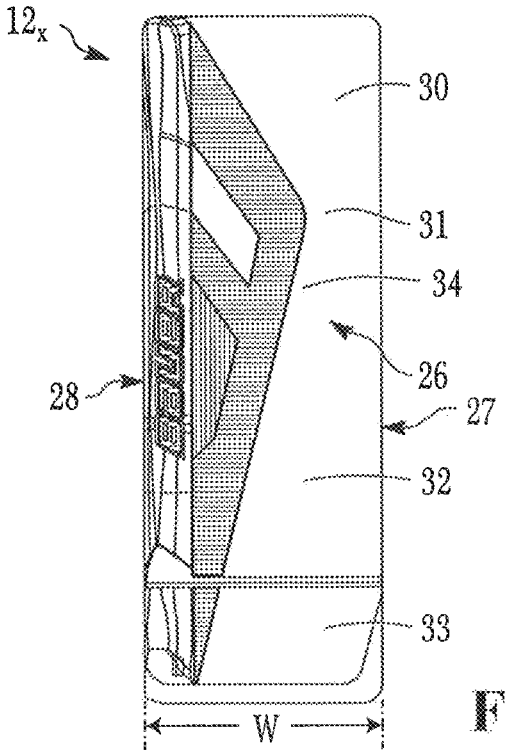
FIG. 2 shows a front view of a right one of the leg pads.
Figure 5:
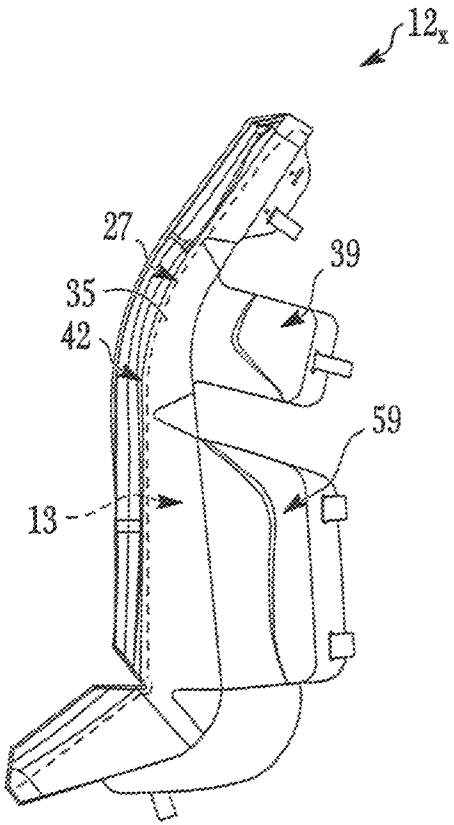
FIGS. 3 to 5 show a front view, a lateral view and a medial view of the leg pad.
Figure 3:
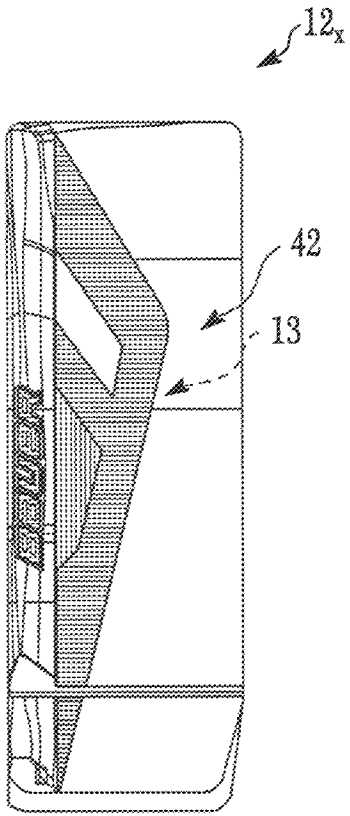
Figure 4:
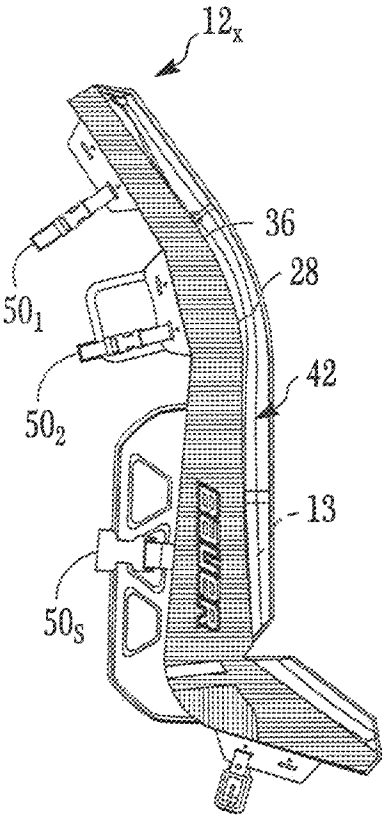
Figure 6:
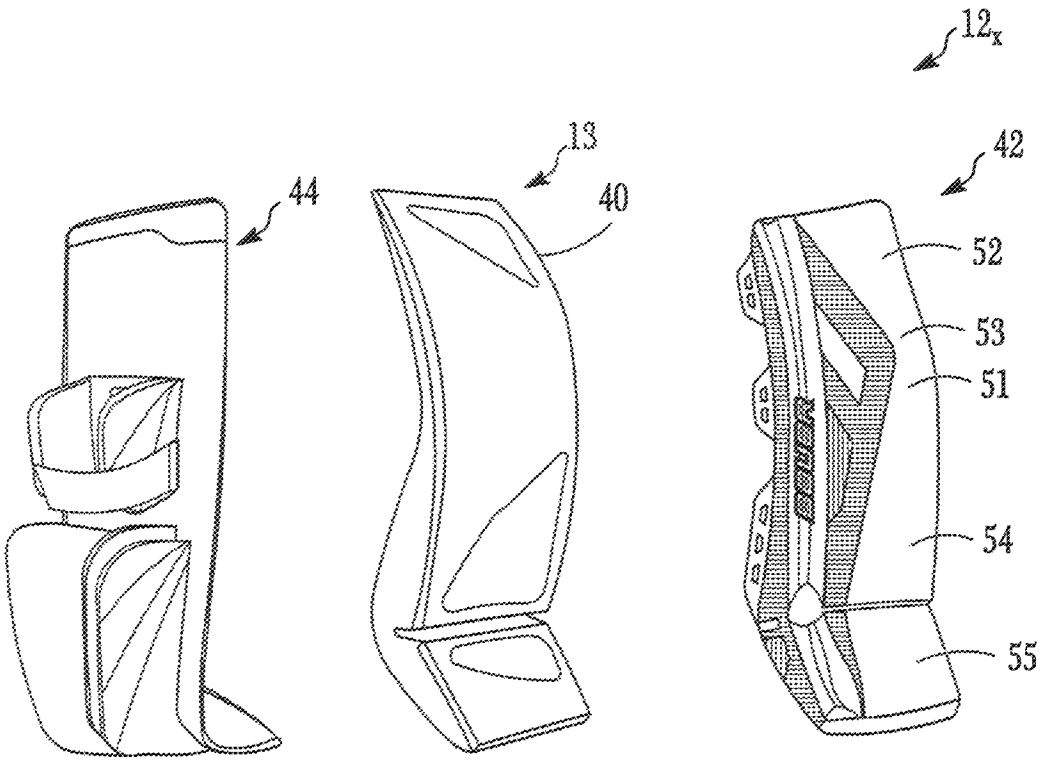
FIG. 6 shows an outer cover, protective padding, and an inner cover of the leg pad, in which the outer cover comprises a printed image.
Figure 7C:
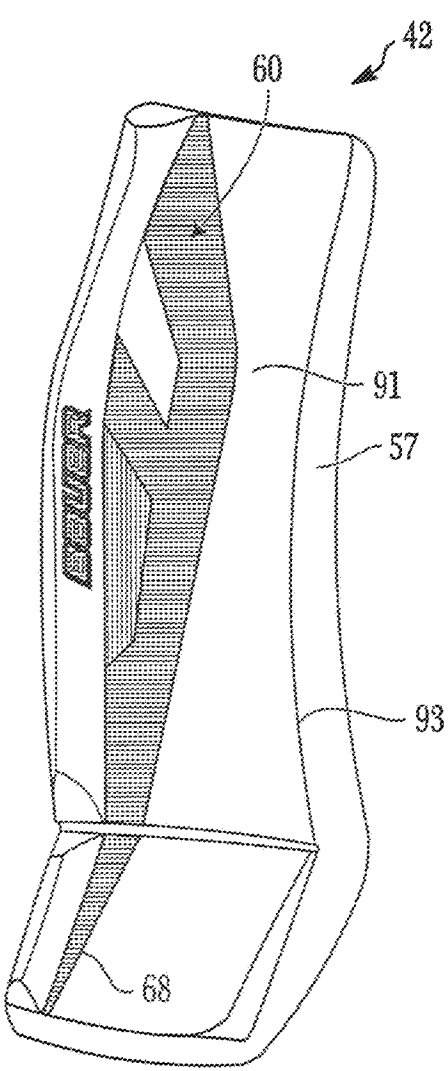
FIGS. 7A to 7C show a front view and perspective views of the outer cover of the leg pad.
Figure 7B:
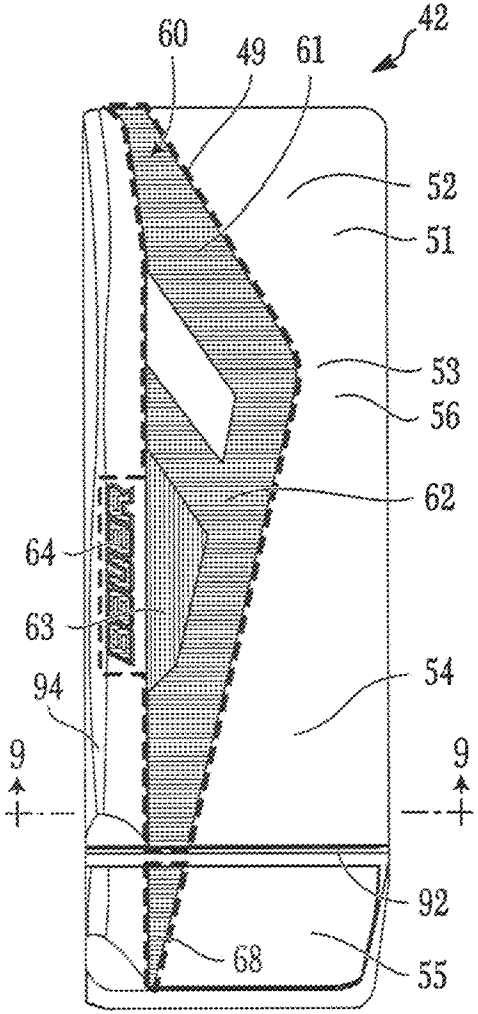
Figure 7A:
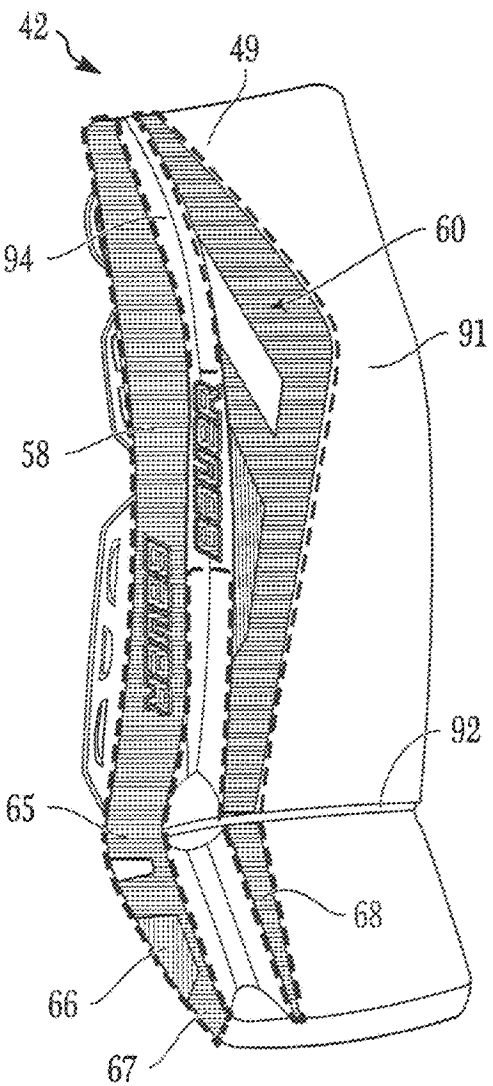
Figure 8:
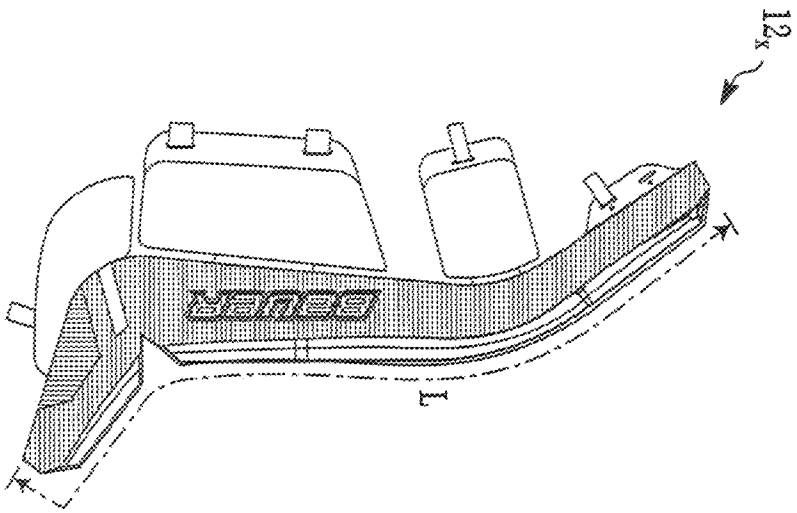
FIG. 8 shows a side view of the leg pad.

FIG. 1 shows an example of athletic gear 10 wearable by a user in accordance with an embodiment of the invention. In this embodiment, the user is a hockey goalkeeper and the athletic gear 10 is protective athletic equipment to protect the hockey goalkeeper while playing hockey. More particularly, in this embodiment, the protective athletic equipment 10 comprises a pair of leg pads $\mathbf{12}_1$, $\mathbf{12}_2$ wearable on the goalkeeper's legs $\mathbf{16}_1$, $\mathbf{16}_2$ while playing hockey to protect the legs $\mathbf{16}_1$, $\mathbf{16}_2$ against an impact from a puck, ball, hockey stick or other object and/or to protect the legs $\mathbf{16}_1$, $\mathbf{16}_2$ when moving (e.g., dropping) them onto a playing surface 11. In this example, a type of hockey played is ice hockey such that the playing surface 11 is ice and the leg pads $\mathbf{12}_1$, $\mathbf{12}_2$ are ice hockey goalkeeper leg pads.

As further discussed later, in this embodiment, the leg pads $\mathbf{12}_1$, $\mathbf{12}_2$ comprise printed graphics (e.g., digitally-printed graphics) as part of their external design. This provides significant freedom in designing an appearance of the leg pads $\mathbf{12}_1$, $\mathbf{12}_2$, notably as this may allow virtually any desired external design, even if very elaborate, to be efficiently imparted to the leg pads $\mathbf{12}_1$, $\mathbf{12}_2$. This can also reduce a weight of each of the leg pads $\mathbf{12}_1$, $\mathbf{12}_2$.

The leg pads $\mathbf{12}_1$, $\mathbf{12}_2$ protect various regions of the goalkeeper's legs $\mathbf{16}_1$, $\mathbf{16}_2$. In this embodiment, with additional reference to FIGS. 2 to 5, 38 and 39, each leg pad $\mathbf{12}_x$ comprises an upper leg portion 30, a knee portion 31, a lower leg portion 32, and a foot portion 33 respectively configured to be positioned adjacent to an upper leg 18, a knee 19, a lower leg 20, and a foot 21 of a leg $\mathbf{16}_x$ of the goalkeeper when the leg pad $\mathbf{12}_x$ is worn on the leg 16, The upper leg portion 30 is above the knee portion 31, while the lower leg portion 32 is below the knee portion 31 and above the foot portion 33. Each of these portions of the leg pad $\mathbf{12}_x$ comprises a frontal part, a medial part, and a lateral part such that the leg pad $\mathbf{12}_x$ comprises a frontal portion 26, a medial portion 27, and a lateral portion 28 respectively configured to be positioned adjacent to a front 22, a medial side 24, and a lateral side 25 of the goalkeeper's leg $\mathbf{16}_x$ when the leg pad $\mathbf{12}_x$ is worn on the leg $\mathbf{16}_x$. The frontal portion 26 comprises a front 34 of the leg pad $\mathbf{12}_x$, the medial portion 27 comprises a medial side 35 of the leg pad $\mathbf{12}_x$, and the lateral portion 28 comprises a lateral side 36 of the leg pad $\mathbf{12}_x$. In this embodiment, the knee portion 31 comprises a knee wing 39 and the lower leg portion 32 comprises a calf wing 59.

The leg pad $\mathbf{12}_x$ can be secured to the goalkeeper's leg $\mathbf{16}_x$ in any suitable way. For example, in this embodiment, the leg pad $\mathbf{12}_x$ comprises straps $\mathbf{50}_1$-$\mathbf{50}_S$ to secure the leg pad $\mathbf{12}_x$ to the goalkeeper's leg $\mathbf{16}_x$.

With additional reference to FIGS. 6, 7A to 7C and 8, in this embodiment, the leg pad $\mathbf{12}_x$ comprises an outer cover 42, an inner cover 44, and a core 13 comprising protective padding 40 that is disposed between the outer cover 42 and the inner cover 44.

The outer cover 42 comprises an outer surface 51 of the leg pad $\mathbf{12}_x$ that faces away from the goalkeeper's leg $\mathbf{16}_x$. In this embodiment, the outer cover 42 comprises an upper leg portion 52, a knee portion 53, a lower leg portion 54, and a foot portion 55 which constitute respective parts of the upper leg portion 30, the knee portion 31, the lower leg portion 32, and the foot portion 33 of the leg pad $\mathbf{12}_x$. Each of these portions of the outer cover 42 comprises a frontal part, a medial part, and a lateral part such that the outer cover 42 comprises a frontal portion 56, a medial portion 57, and a lateral portion 58 which constitute respective parts of the frontal portion 26, the medial portion 27, and the lateral portion 28 of the leg pad $\mathbf{12}_x$.

The outer cover 42 is a printed outer cover. That is, the outer cover 42 comprises a printed image 60 (i.e., an image created by a printing process). The printed image 60 can be any desired image. For example, in various embodiments, the printed image 60 may include a graphical representation of: one or more alphanumeric characters that may form text (e.g., a word, a message, etc.); one or more symbols (e.g., a logo, a sign, an emblem, etc.); one or more shapes or patterns; and/or one or more real or imaginary objects (e.g., a person, an animal, a vehicle, a weapon, a work of art, a food item, an imaginary or fictional character, or any other real or imaginary thing). This may allow the external design of the leg pad $12_x$ to be elaborate and/or possibly customized or personalized for the goalkeeper.

In this example of implementation, the printed image 60 includes: a colored pattern 61 having a generally triangular configuration with areas 62, 63 of different colors on the frontal portion 56 of the outer cover 42; a word 64 (i.e., "BAUER") on the frontal portion 56 of the outer cover 42; another colored pattern 65 including areas 66, 67 of different colors in each of the medial portion 57 and the lateral portion 58 of the outer cover 42; and a generally triangular colored shape 68 in the foot portion 55 of the outer cover 42. The printed image 60 can be any other desired image in other examples of implementation.

The printed image 60 can occupy all or a significant part of the outer surface 51 of the leg pad $12_x$. For example, in some embodiments, a print area 49 of the printed image 60 (i.e., an area which has been printed) may occupy at least 10% of a surface area of the front 34 of the leg pad $12_x$, in some cases at least 20% of the surface area of the front 34 of the leg pad $12_x$, in some cases at least 30% of the surface area of the front 34 of the leg pad $12_x$, in some cases at least 40% of the surface area of the front 34 of the leg pad $12_x$, in some cases at least 50% of the surface area of the front 34 of the leg pad $12_x$, and in some cases even more (e.g., up to substantially an entirety of the surface area of the front 34 of the leg pad $12_x$). As another example, in some embodiments, the print area 49 of the printed image 60 may span at least one-fifth of a length L of the leg pad $12_x$, in some cases at least one-quarter of the length L of the leg pad $12_x$, in some cases at least one-third of the length L of the leg pad $12_x$, in some cases at least one-half of the length L of the leg pad $12_x$, and in some cases even more (e.g., up to substantially an entirety of the length L of the leg pad $12_x$), and/or may span at least one-fifth of a width W of the leg pad $12_x$, in some cases at least one-quarter of the width W of the leg pad $12_x$, in some cases at least one-third of the width W of the leg pad $12_x$, in some cases at least one-half of the width W of the leg pad $12_x$, and in some cases even more (e.g., up to substantially an entirety of the width W of the leg pad $12_x$). The print area 49 of the printed image 60 may occupy any other desired part of the outer surface 51 of the leg pad $12_x$ in other embodiments.

Figure 9:
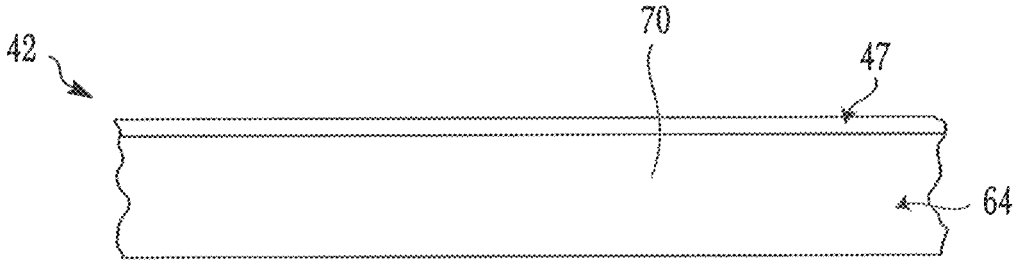
FIG. 9 shows a cross-sectional view of part of the outer cover of the leg pad.

In this embodiment, with additional reference to FIG. 9, the outer cover 42 comprises a base 64 and a covering 47 that is disposed on the base 64 and includes the printed image 60.

More particularly, in this embodiment, the base 64 comprises molded material 70 formed during a molding process such that a shape of the outer cover 42 is a molded shape imparted during the molding process. The molded material 70 constitutes at least a majority (i.e., a majority or an entirety) of the outer cover 42. The upper leg portion 52, the knee portion 53, the lower leg portion 54, and the foot portion 55 of the outer cover 42 comprise respective parts of the molded material 70 which have been shaped by the molding process. For instance, in some examples of implementation, the base 64 of the outer cover 42, including its molded material 70, may be implemented as described in U.S. patent application Ser. No. 14/212,518 filed on Mar. 14, 2014 and hereby incorporated by reference herein.

The molded shape of the outer cover 42 may have any suitable configuration. In this embodiment, the outer cover 42 has a molded bent configuration such that it bends in a longitudinal direction of the leg pad $12_x$. More particularly, in this embodiment, the outer cover 42 includes a bend 91 in the longitudinal direction of the leg pad $12_x$ between the upper leg portion 52 and the lower leg portion 54 adjacent to the knee portion 53, and a bend 92 in the longitudinal direction of the leg pad $12_x$ between the lower leg portion 53 and the foot portion 55. In this example, the bend 91 is a curved part which defines a curvature of the outer cover 42, while the bend 92 is an angular part which defines an oblique angle. Also, in this embodiment, the molded bent configuration of the outer cover 42 is such that the outer cover 42 bends in a widthwise direction of the leg pad $12_x$. More particularly, in this embodiment, the outer cover 42 includes a bend 93 in the widthwise direction of the leg pad $12_x$ between the frontal portion 56 and the medial portion 57 of the outer cover 42, and a bend 94 in the widthwise direction of the leg pad $12_x$ between the frontal portion 56 and the lateral portion 58 of the outer cover 42. The molded bent configuration of the outer cover 42 may be arranged in any other suitable way in other embodiments (e.g., include any number of bends, curved or angular, disposed in any suitable manner).

In this embodiment, the molded material 70 of the outer cover 42 comprises molded foam. This provides shock absorbability to the outer cover 42 which may help in protecting the goalkeeper's leg $16_x$. More particularly, in this embodiment, the molded foam 70 is ethylene vinyl acetate (EVA) foam. Any other suitable foam may be used in other embodiments (e.g., polyethylene foam (e.g., low-density polyethylene foam), polyurethane foam, polypropylene foam, etc.). In some examples of implementation, the molded foam of the molded material 70 may include a single type of foam. In other examples of implementation, the molded foam of the molded material 70 may include two or more different types of foam, such as foams having different densities and/or different material compositions (e.g., an outer layer of foam that is denser than an inner layer of foam; a layer of EVA foam and another layer of polyurethane foam; etc.).

The molded material 70 may comprise any suitable material other than foam in other embodiments (e.g., polymeric material such as thermoplastic polyurethane or any other elastomeric material, a gel, etc.).

The molding process of the outer cover 42 may employ any suitable molding method. In this embodiment, the molding process is compression molding. An amount of material which is to become the molded material 70 of the outer cover 42 is introduced into a mold that is initially open and then shaped by heat and by pressure created as the mold is closed and the material is forced into contact with mold areas. A deflashing (i.e., flash removal) operation may be performed to remove any excess material from the molding operation. The molded material 70 of the outer cover 42 may be formed using any other suitable molding method in other embodiments (e.g., injection molding, thermoforming, etc.).

The covering 47 is affixed to the base 64, includes the printed image 60, and constitutes at least a majority of the outer surface 51 of the leg pad $12_x$. In that sense, the covering 47 may be viewed as a "skin" of the outer cover 42. In this example of implementation, the covering 47 constitutes substantially an entirety of the outer surface 51 of the leg pad $12_x$.

In this embodiment, the covering 47 is bonded to the molded material 70 of the base 64. The covering 47 is applied on the molded material 70 after molding of the molded material 70 into the shape of the outer cover 42 and is significantly thinner than the molded material 70. More particularly, in this embodiment, the covering 47 is adhesively bonded to the molded material 70. In some cases, the covering 47 may include an adhesive backing that can be adhesively bonded to the molded material 70. In other cases, an adhesive may be applied between the molded material 70 and a backside of the covering 47 when the covering 47 is being applied to the molded material 70. In other embodiments, the covering 47 may be chemically bonded to the molded material 70, instead of being adhesively bonded.

Figure 10:
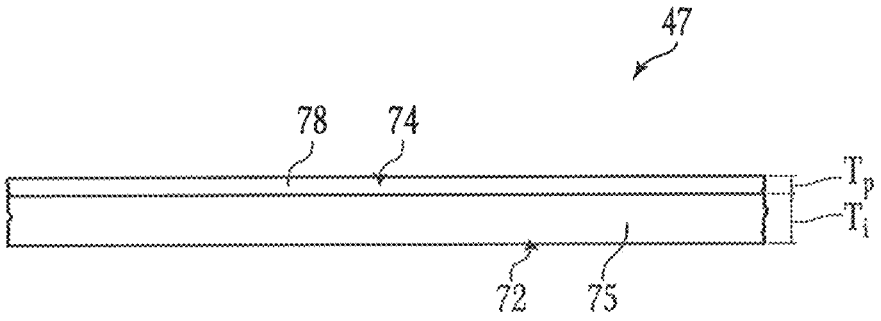
FIG. 10 shows a cross-sectional view of part of a covering of the outer cover of the leg pad.

With additional reference to FIG. 10, in this embodiment, the covering 47 comprises a printed layer 72 and a transparent protective layer 74 over the printed layer 72.

The printed layer 72 includes synthetic material 75 on which the printed image 60 has been printed. The synthetic material 75 may thus initially be of a base color (e.g., white) on which one or more coloring substances (e.g., one or more toners, inks or other substances including pigments) are applied during the printing process to create the printed image 60. The synthetic material 75 may be provided as one or more sheets on which the printing process is carried out. In this embodiment, the synthetic material 75 is polymeric material. More particularly, in this embodiment, the polymeric material 75 includes polyurethane (PU). In various cases, the PU may be provided as a single PU layer or multiple PU layers, thermoplastic polyurethane (TPU), and/or in any other suitable form. In this example of implementation, the polymeric material 75 includes a layer of PU on a layer of microfiber. For instance, the layer of PU may be thinner than the layer of microfiber (e.g., the layer of PU may have a thickness of 0.2 mm, while the layer of microfiber may have a thickness of 1.1 mm). The polymeric material 75 may include any other suitable polymer in other embodiments (e.g., nylon, polyester, vinyl, etc.). In some cases, the polymeric material 75 may be a polymer-matrix composite material (e.g., in which fibers are embedded in a polymer matrix, such as a CURV™ composite material). The synthetic material 75 may be implemented in any other suitable way in other embodiments.

The transparent protective layer 74 overlies the printed layer 72 and allows the printed image 60 to be viewed while protecting the printed layer 72. In this embodiment, the transparent protective layer 74 includes one or more films of transparent polymeric material 78 disposed onto the polymeric material 75 of the printed layer 72. More particularly, in this embodiment, the polymeric material 78 includes polyurethane (PU). For instance, in some examples of implementation, the polymeric material 78 may be a layer of PU Unico Frost P259 having a thickness of 0.2 mm. The polymeric material 78 may include any other suitable polymer in other embodiments. Also, in other embodiments, the transparent protective layer 74 may include a coating applied to the printed layer 72 in fluid form.

In this embodiment, the transparent protective layer 74 is thinner than the printed layer 72. For example, in some embodiments, a ratio $T_i/T_p$ of a thickness $T_i$ of the printed layer 72 over a thickness $T_p$ of the transparent protective layer 74 may be at least 1.2, in some cases at least 1.5, in some cases at least 2, in some cases at least 3, in some cases at least 4, in some cases at least 5, and in some cases even more (e.g., 6 or more). For instance, in this embodiment, the thickness $T_i$ of the printed layer 72 may be between about 0.7 mm and about 1.1 mm and the thickness $T_p$ of the transparent protective layer 74 may be about 0.2 mm.

The transparent protective layer 74 may be bonded to the printed layer 72 in any suitable way. In this embodiment, the transparent protective layer 74 is bonded to the printed layer 72 by being laminated onto the printed layer 72. For instance, a chemical bond may be created (e.g., by a laminating roller apparatus) when laminating the transparent protective layer 74 onto the printed layer 72.

Figure 11:
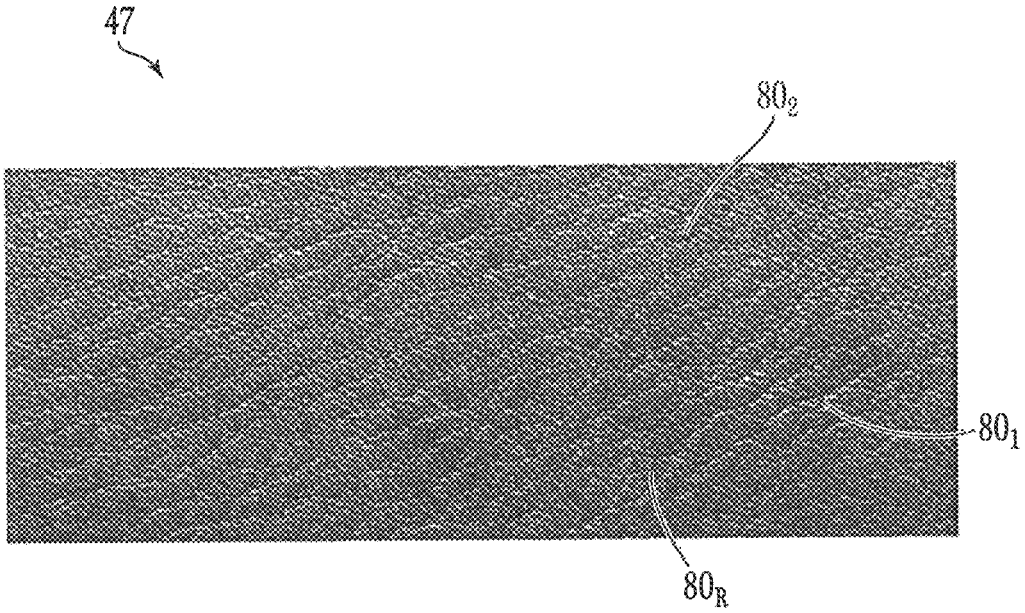
FIG. 11 shows a texture of the covering.

The covering 47 may be textured (e.g., to provide it with a more "natural" look akin to natural leather). For example, with reference to FIG. 11, in this embodiment, a texture of the covering 47 includes a network of shallow recesses $\mathbf{80}_1$-$\mathbf{80}_R$ intersecting one another to mimic natural leather. More particularly, in this embodiment, the shallow recesses $\mathbf{80}_1$-$\mathbf{80}_R$ are formed in the transparent protective layer 74. For instance, the transparent protective layer 74 may be imprinted (e.g., by a roller format release paper) to create the shallow recesses $\mathbf{80}_1$-$\mathbf{80}_R$ providing texture.

Figure 12:
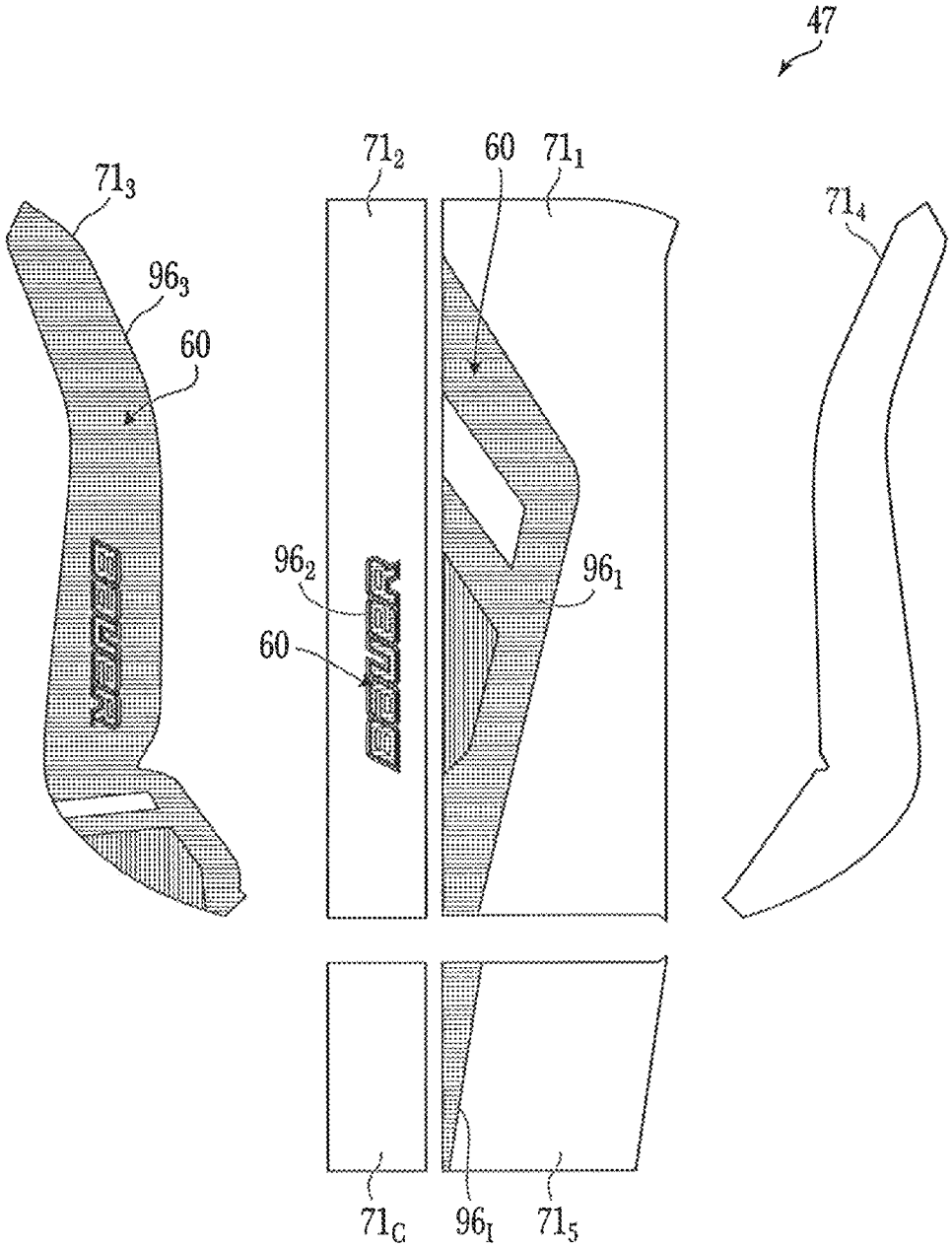
FIG. 12 shows different covering pieces of the covering.

In this embodiment, with reference to FIG. 12, the covering 47, including the printed image 60, comprises a plurality of separate covering pieces $\mathbf{71}_1$-$\mathbf{71}_C$ which include respective portions $\mathbf{96}_1$-$\mathbf{96}_I$ of the printed image 60 and which are assembled together and affixed on the base 64 to collectively visually compose the printed image 60. More specifically, in this embodiment, the covering 47 comprises a main frontal piece $\mathbf{71}_1$, a frontal edge piece $\mathbf{71}_2$, a lateral piece $\mathbf{71}_3$, a medial piece $\mathbf{71}_4$, a main foot piece $\mathbf{71}_5$ and a foot edge piece $\mathbf{71}_C$. The main frontal piece $\mathbf{71}_1$ includes a first portion $\mathbf{96}_1$ of the printed image 60; the lateral frontal piece $\mathbf{71}_2$ includes a second portion $\mathbf{96}_2$ of the printed image 60; the lateral piece includes a third portion $\mathbf{96}_3$ of the printed image 60; and the main foot portion $\mathbf{71}_4$ includes a fourth portion $\mathbf{96}_I$ of the printed image 60. The covering pieces $\mathbf{71}_1$-$\mathbf{71}_C$ may include any other number of pieces in other embodiments and/or may include a different number of portions of the printed image 60.

Each of the covering pieces $\mathbf{71}_1$-$\mathbf{71}_C$ is configured to form a respective part of the outer surface 51 of the leg pad $\mathbf{12}_x$. For instance, the main frontal piece $\mathbf{71}_1$ is configured to form a majority of that part of the outer surface 51 of the leg pad $\mathbf{12}_x$ in the frontal portion 56 of the outer cover 42; the frontal edge piece $\mathbf{71}_2$ is configured to form that part of the outer surface 51 of the leg pad $\mathbf{12}_x$ in an edge region of the frontal portion 56 closest to the lateral portion 58 of the outer cover 42; the lateral piece $\mathbf{71}_3$ is configured to form that part of the outer surface 51 of the leg pad $\mathbf{12}_x$ in the lateral portion 58 of the outer cover 42; the medial piece $\mathbf{71}_4$ is configured to form that part of the outer surface 51 of the leg pad $\mathbf{12}_x$ in the medial portion 57 of the outer cover 42; the main foot piece $\mathbf{71}_5$ is configured to form a majority of that part of the outer surface 51 of the leg pad $\mathbf{12}_x$ in the foot portion 55 of the outer cover 42; and the foot edge piece $\mathbf{71}_C$ is configured to form that part of the outer surface 51 of the leg pad $\mathbf{12}_x$ in an edge region of the foot portion 55 closest to the lateral portion 58 of the outer cover 42.

In other embodiments, the covering 47, including the printed image 60, may be a one-piece covering (i.e., constituted by a single piece) which comprises an entirety of the printed image 60.

The printed image 60 can be provided on the outer cover 42 using any suitable printing technique.

Figure 13:
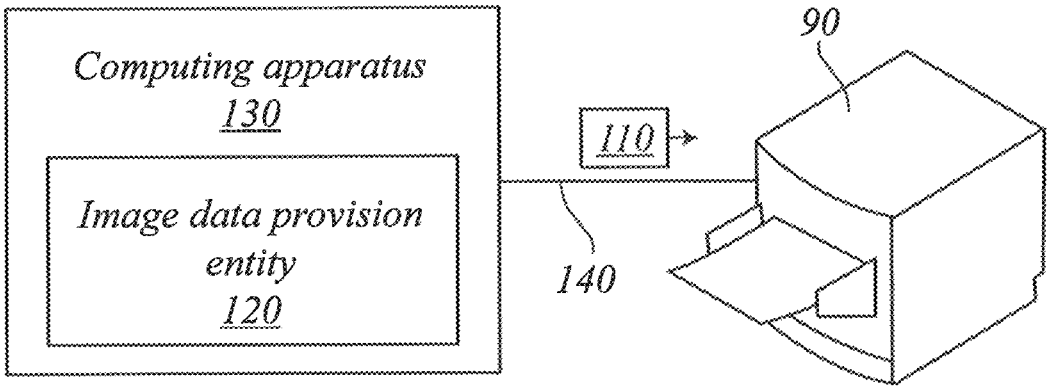
FIG. 13 shows a digital printer and a computing apparatus used for printing the printed image of the outer cover of the leg pad in accordance with an embodiment of the invention.
Figure 14:
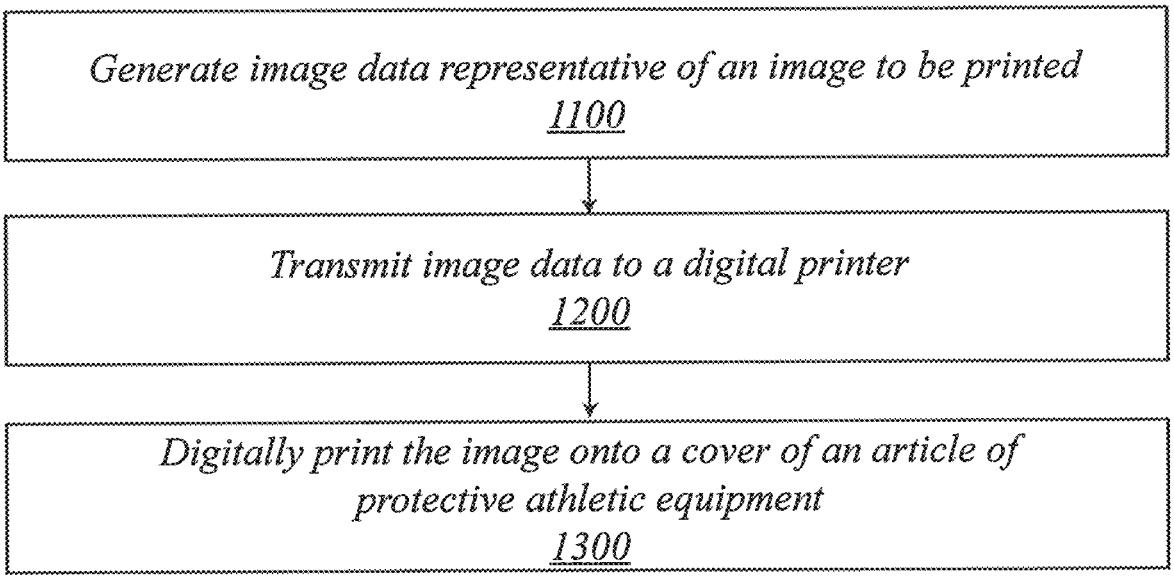
FIG. 14 shows an example of a flow diagram illustrating steps for producing the printed image of the outer cover in accordance with an embodiment of the invention.

In this embodiment, with additional reference to FIGS. 13 and 14, the printed image 60 is a digitally-printed image that is digitally printed on the polymeric material 75 of the covering 47 by a digital printer 90. The digital printer 90 is connected to a computing apparatus 130 comprising an image data provision entity 120. Digital printing may allow the printed image 60 to have a high degree of elaborateness and/or resolution, notably in view of high dots per inch (DPI) characteristics that the digital printer 90 may have.

At step 1100, the image data provision entity 120 is configured to generate image data 110 representative of the printed image 60 to be created. For instance, in some embodiments, the image data provision entity 120 may comprise one or more digital imaging devices and/or one or more computer applications (e.g., imaging applications to create and/or edit images) that can be used to generate the image data 110. For example, a user may use an imaging application (e.g., Adobe Illustrator®) to create an original digital image, from which the image data 110 is generated. As another example, a scanner may be used to scan a picture or other physical image or a digital camera may be used to take a digital picture, from which the image data 110 is generated. As yet another example, a user may use both a digital imaging device and an imaging application to generate the image data 110.

At step 1200, the image data provision entity 120 is configured to transmit the image data 110 to the digital printer 90 over a communication link 140. The communication link 140 may be implemented by a dedicated connection (e.g., a cable) between the computing apparatus 130 and the digital printer 90 and/or by one or more of a data network (e.g., the Internet, a wide area network (WAN), a local area network (LAN)), a public telephony network (e.g., the Public Switched Telephone Network (PSTN)), and/or a wireless network (e.g., a cellular network). Thus, the digital printer 90 and the computing apparatus 130 may reside in a common physical location or in remote physical locations in various embodiments.

At step 1300, the digital printer 90 is configured to receive and process the image data 110 in order to print the printed image 60 onto the polymeric material 75 of the covering 47. Any suitable printing process may be implemented by the digital printer 90.

For example, in some embodiments, the digital printer 90 may be an inkjet printer (e.g., a large-format inkjet printer) implementing an inkjet printing process. In this case, the digital printer 90 comprises a plurality of inks having a range of colors. The digital printer 90 propels droplets of ink onto the polymeric material 75 of the covering 47 in a manner conveyed by the image data 110 after the latter has been processed by the digital printer 90. In other words, the digital printer 90 chooses which inks, i.e., pigments, to use and where to apply them based on the received image data 110.

As another example, in some embodiments, the digital printer 90 may be a sublimation printer implementing a sublimation printing process. In this case, the digital printer 90 comprises a plurality of subliminal dyes having a range of colors. The subliminal dyes are stored in a solid state and are heated by the digital printer 90 to a certain temperature (e.g., approximately 200° C.) at which point the subliminal dyes acquire their gaseous state through a sublimation phase transition. The digital printer 90 then applies the subliminal dyes to the polymeric material 75 of the covering 47 in a manner conveyed by the image data 110 after the latter has been processed by the digital printer 90. In other words, the digital printer 90 chooses which subliminal dyes, i.e., pigments, to use and where to apply them based on the received image data 110. In this example, in order to implement the sublimation printing process, the polymeric material 75 of the covering 47 is originally of a pale shade or white since the subliminal dyes are translucent and thus transmit light. Upon application, the molecules of the subliminal dyes bind with the molecules of the polymeric material 75 and penetrate its surface, thus creating the printed image 60 onto the covering 47.

The digital printer 90 may employ any other suitable printing technology in other embodiments.

Figure 15:
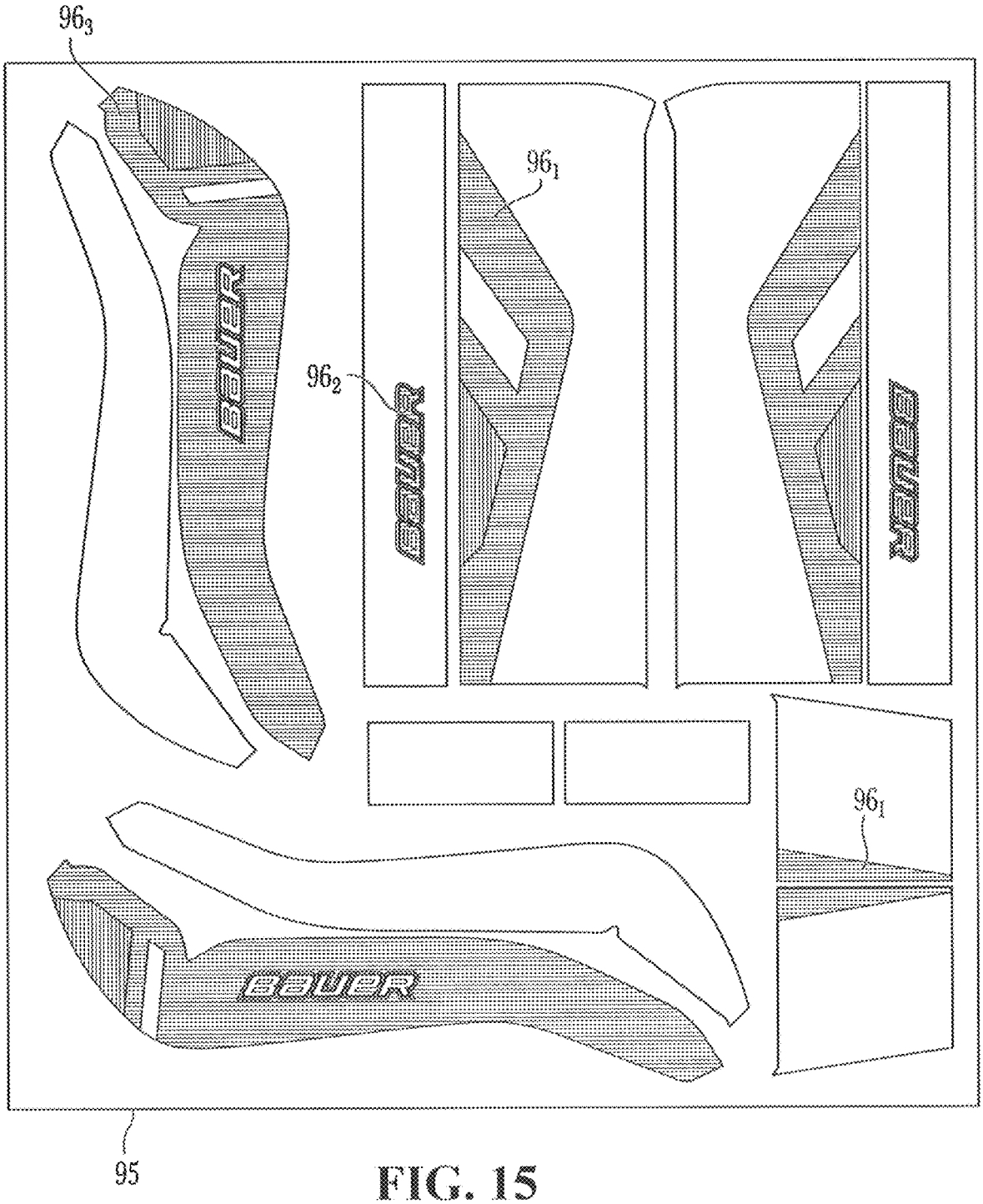
FIG. 15 shows an example of a common sheet on which image portions of the printed image are printed.

In this embodiment, with additional reference to FIG. 15, the digital printer 90 prints two or more of the image portions $\mathbf{96}_1$-$\mathbf{96}_I$ of the covering pieces $\mathbf{71}_1$-$\mathbf{71}_C$ onto a common sheet 95, i.e. a template. More specifically, in this case, the digital printer 90 prints all of the image portions $\mathbf{96}_1$-$\mathbf{96}_I$ onto the common sheet 95. In other words, the common sheet 95 accommodates all of the image portions $\mathbf{96}_1$-$\mathbf{96}_I$ necessary to produce the totality of the printed image 60. In this case, the common sheet 95 accommodates two sets of image portions $\mathbf{96}_1$-$\mathbf{96}_I$ required to produce both of the leg pads $\mathbf{12}_1$, $\mathbf{12}_2$. In some embodiments, the common sheet 95 may accommodate even more image portions to produce more than the pair of leg pads $\mathbf{12}_1$, $\mathbf{12}_2$. Moreover, the image portions $\mathbf{96}_1$-$\mathbf{96}_I$ may be accommodated on the common sheet 95 in such a way as to optimally use the space available on the common sheet 95, i.e. to fit as many image portions $\mathbf{96}_1$-$\mathbf{96}_I$ as possible on the common sheet 95. This can minimize an amount of material of the common sheet 95 that is wasted after the printing process.

In this embodiment, once the printed image 60 is created on the polymeric material 75 of the covering 47, the transparent protective layer 74 is laminated onto the printed layer 72.

The common sheet 95, on which the image portions $\mathbf{96}_1$-$\mathbf{96}_I$ of the printed image 60 have been printed, is then cut into separate pieces resulting in the covering pieces $\mathbf{71}_1$-$\mathbf{71}_C$ of the covering 47 described above. Each of the covering pieces $\mathbf{71}_1$-$\mathbf{71}C$ thus includes the transparent protective layer 74 that was laminated onto the printed layer 72.

The covering 47, including the printed image 60, is affixed to the base 64 to provide the outer cover 42. More particularly, in this embodiment, as discussed above, the covering 47 is adhesively bonded to the base 64. In this example, the separate covering pieces $\mathbf{71}_1$-$\mathbf{71}_C$ which include the respective portions $\mathbf{96}_1$-$\mathbf{96}_I$ of the printed image 60 are assembled together and adhesively bonded to the base 64.

Figure 16:
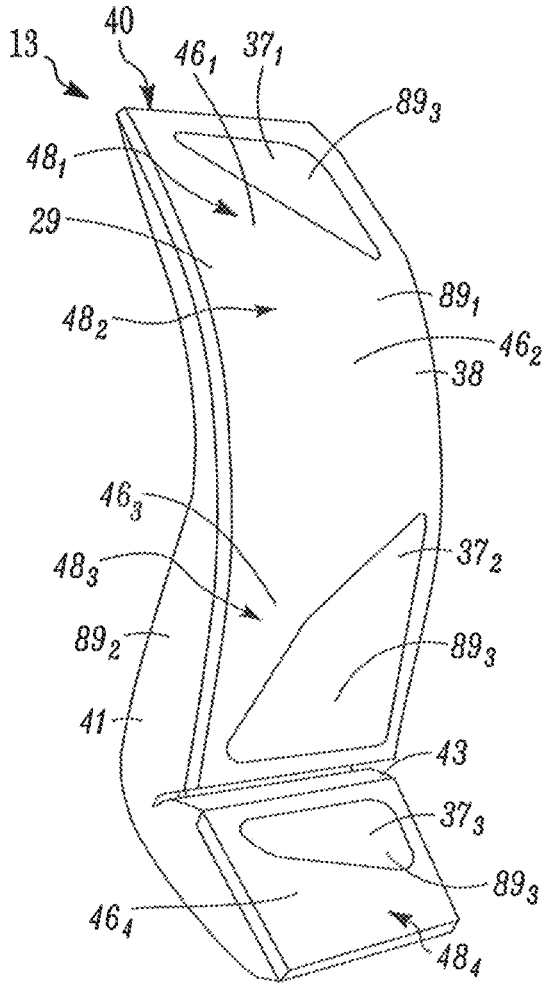
FIGS. 16 and 17 respectively show a perspective view and a side view of the protective padding of the leg pad.

The protective padding 40 provides padded protection to the goalkeeper's leg $\mathbf{16}_x$. With additional reference to FIG. 16, in this embodiment, the protective padding 40 comprises an upper leg padding portion $\mathbf{48}_1$, a knee padding portion $\mathbf{48}_2$, a lower leg padding portion $\mathbf{48}_3$ and a foot padding portion $\mathbf{48}_4$ constituting respective parts of the upper leg portion 30, the knee portion 31, the lower leg portion 32, and the foot portion 33 of the leg pad $\mathbf{12}_x$. In this example, respective ones of the padding portions $\mathbf{48}_1$-$\mathbf{48}P$ are part of a common continuous pad that extends from the upper leg portion 30 to the foot portion 33 of the leg pad $\mathbf{12}_x$.

In this embodiment, the protective padding 40 comprises a plurality of padding materials $\mathbf{89}_1$-$\mathbf{89}_3$ that are different from one another. In this example, the padding materials $\mathbf{89}_1$-$\mathbf{89}_3$ are different types of foam, such as polyurethane foam, ethylene vinyl acetate (EVA) foam, polypropylene (PP) foam, polyethylene (PE) foam), vinyl nitrile (VN) foam, or any other suitable foam. More particularly, in this example, the padding material $\mathbf{89}_1$ is a type of polyethylene foam (e.g., high-density polyethylene foam), the padding material $\mathbf{89}_2$ is a different type of polyethylene foam (e.g., low-density polyethylene foam), and the padding material $\mathbf{89}_3$ is a polyurethane foam (e.g., Poron XRD™). In other embodiments, one or more of the padding materials $\mathbf{89}_1$-$\mathbf{89}_3$ may be material other than foam, such as a gel or any other suitable shock-absorbing material.

More particularly, in this embodiment, the padding material $\mathbf{89}_1$ forms an outer layer 38 of the protective padding 40 and is stiffer (e.g., denser) than the padding material $\mathbf{89}_2$ which forms an inner layer 41 of the protective padding 40. This may impart rigidity to the protective padding 40 or enhance an impact resistance and/or a shock absorbance of the protective padding 40.

Also, in this embodiment, the padding material $\mathbf{89}_3$ is disposed in specific limited areas $\mathbf{37}_1$-$\mathbf{37}_3$ of the protective padding 40 relative to the padding material $\mathbf{89}_1$ to control a rebound effect at these areas when a puck hits these areas. For example, the goalkeeper may prefer a long rebound or a short rebound when a puck hits a particular area and the padding material $\mathbf{89}_3$ may be distributed to customize a puck rebound profile of the leg pad $\mathbf{12}_x$ according to the goalkeeper's preference. For a given puck impact speed, the rebound effect is thus different in the areas $\mathbf{37}_1$-$\mathbf{37}_3$ of the protective padding 40 than in other areas $\mathbf{46}_1$-$\mathbf{46}_4$ of the protective padding 40 outside these areas $\mathbf{37}_1$-$\mathbf{37}_3$.

A shape of the protective padding 40 generally conforms to the outer cover 42. In this embodiment, the protective padding 40 has a bent configuration such that it bends in a longitudinal direction of the leg pad $\mathbf{12}_x$ to generally conform to the molded bent configuration of the outer cover 42. More particularly, in this embodiment, the protective padding includes a bend 29 in the longitudinal direction of the leg pad $\mathbf{12}_x$ between the upper leg padding portion $\mathbf{48}_1$ and the lower leg padding portion $\mathbf{48}_3$ and a bend 43 in the longitudinal direction of the leg pad $\mathbf{12}_x$ between the lower leg padding portion $\mathbf{48}_3$ and the foot padding portion $\mathbf{48}_4$. In this example, the bend 29 is a curved part which defines a curvature of the protective padding 40, while the bend 43 is an angular part which defines an oblique angle. The bent configuration of the protective padding 40 may be arranged in any other suitable way in other embodiments (e.g., include any number of bends, curved or angular, disposed in any suitable manner).

The protective padding 40 may be manufactured in any suitable way. In this embodiment, the outer layer 38 of the protective padding 40, which is made of the padding material $\mathbf{89}_1$, is molded or machined, while the inner layer 41 of the protective padding 40, which is made of the padding material $\mathbf{89}_2$, is machined. Also, in this embodiment, the padding materials $\mathbf{89}_1$-$\mathbf{89}_3$ are adhesively bonded. Any suitable adhesive may be used (e.g., Contact Cement™, Spray Glue, etc.). The padding materials $\mathbf{89}_1$-$\mathbf{89}_3$ may be retained together in any other suitable way in other embodiments (e.g., by being overmolded). The protective padding 40 may be made using any other suitable manufacturing methods in other embodiments.

Figure 17:
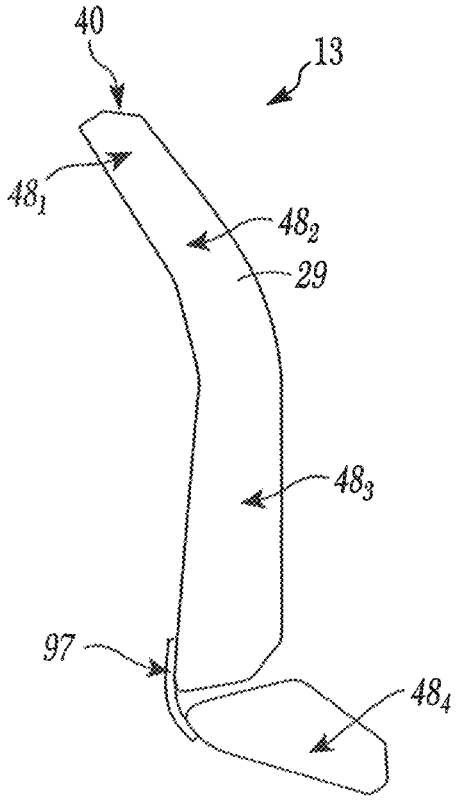

The protective padding 40 may be implemented in various other ways in other embodiments. For example, in other embodiments, the padding 40 may be made of a single shock-absorbing material (e.g., a single foam). As another example, in other embodiments, different ones of the padding portions $\mathbf{48}_1$-$\mathbf{48}_4$ may be part of distinct pads separate from one another. For instance, in some embodiments, the foot padding portion $\mathbf{48}_4$ may be separate from the lower leg padding portion $\mathbf{48}_3$. That is, the foot padding portion 484 and the lower leg padding portion $\mathbf{48}_3$ may be distinct pads that are separate from one another and assembled during manufacturing of the leg pad $\mathbf{12}_x$. For example, each of the foot padding portion $\mathbf{48}_4$ and the lower leg padding portion $\mathbf{48}_3$ may be a pad molded, machined, or otherwise formed individually as a distinct piece. As shown in FIG. 17, in some cases, a link 97 may be affixed to the foot padding portion $\mathbf{48}_4$ and the lower leg padding portion $\mathbf{48}_3$ to interconnect the foot padding portion $\mathbf{48}_4$ and the lower leg padding portion $\mathbf{48}_3$. For example, the link may comprise a band stitched, adhesively bonded, or otherwise affixed to the foot padding portion $\mathbf{48}_4$ and the lower leg padding portion $\mathbf{48}_3$. In other cases, there may be no link between the foot padding portion $\mathbf{48}_4$ and the lower leg padding portion $\mathbf{48}_3$, which may be retained purely by their placement between the outer cover 42 and the inner cover 44.

Figure 18:
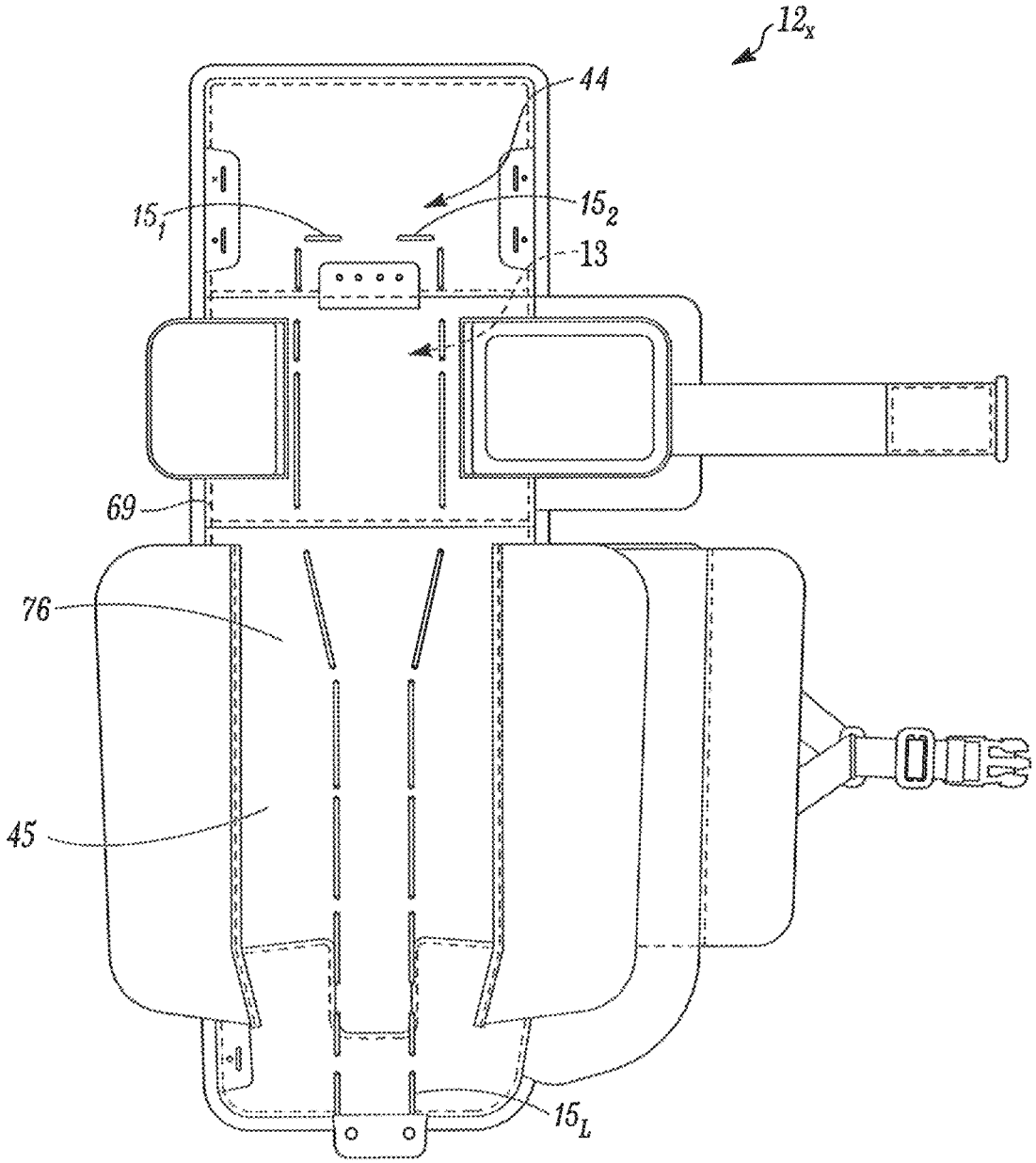
FIG. 18 shows a back view of the leg pad.

With additional reference to FIG. 18, the inner cover 44 comprises an inner surface 45 of the leg pad $\mathbf{12}_x$ that faces the goalkeeper's leg $\mathbf{16}_x$. The inner cover 44 may comprise any suitable material. For example, in this embodiment, the inner cover 44 comprises fabric 76. For instance, in some examples of implementation, the fabric of the inner cover 44 may comprise a woven fabric, a nonwoven fabric, synthetic microfibers, a synthetic woven knit, a polyurethane laminate, a mesh, or any other suitable fabric. The inner cover 44 may be implemented in various other ways in other embodiments.

Figure 19:
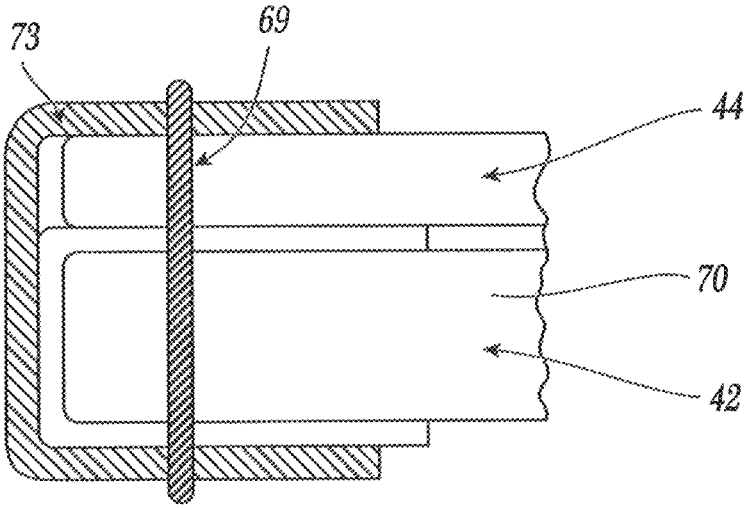
FIG. 19 shows an assembly of the outer cover, the protective padding and the inner cover of the leg pad.

The leg pad $\mathbf{12}_x$ is assembled by placing the protective padding 40 between the outer cover 42 and the inner cover 44 and securing them together. To that end, in this embodiment, the outer cover 42 is fastened to at least one, in this case both, of the inner cover 44 and the protective padding 40. More particularly, with reference to FIGS. 18 and 19, in this embodiment, a fastener 69 interacts with the outer cover 42 and the inner cover 44 to secure the inner cover 44, the protective padding 40, and the outer cover 42 together. In this example, the fastener 69 is a series of stitches that stitch together the inner cover 44 and the outer cover 42. The fastener 69 may be any other suitable fastener in other examples (e.g., an adhesive, a series of staples, etc.). In this case, the outer cover 42 is secured to the inner cover 44 through a binding 73 that extends along at least part (e.g., a majority or an entirety) of a periphery of the outer cover 42 and at least part (e.g., a majority or an entirety) of a periphery of the inner cover 44. The fastener 69, in this case stitches, extends through the binding 73 and fastens the outer cover 42 and the inner cover 44 together, with the protective padding 40 in between. In addition to being retained between the outer cover 42 and the inner cover 44, in this embodiment, the protective padding 40 is also laced to the cover liner 40 via laces $\mathbf{15}_1$-$\mathbf{15}_L$.

The leg pads $\mathbf{12}_1$, $\mathbf{12}_2$ may be constructed in various other ways in other embodiments.

For example, in other embodiments, the leg pads $\mathbf{12}_1$, $\mathbf{12}_2$ may have any other suitable shape and/or be made of any other suitable material.

In some embodiments, the base 64 of the outer cover 42 may not comprise molded material (such as the molded material 70). For instance, the base 64 may comprise one or more panels of synthetic pliable material such as synthetic leather (e.g., polyurethane (PU) leather) or fabric (e.g., nylon fabric, polyester fabric, Cordura™ fabric, etc.) which have not been molded into the shape of the outer cover 42 but rather manually bent or otherwise formed when assembling the leg pad $\mathbf{12}_x$ (e.g., fastening the outer cover 42 to the protective padding 40 and/or the inner cover 44) and on which the covering 47 may be affixed (e.g., bonded or stitched)

In some embodiments, the outer cover 42 may not comprise any base such as the base 64 but may rather be constituted only by the covering 47.

In some embodiments, the printed image 60 of the outer cover 42 may facilitate personalization or customization of the leg pad $\mathbf{12}_x$. For example, a desired design for the outer surface of the leg pad $\mathbf{12}_x$ may be determined by the goalkeeper or another person (e.g., an equipment manager, a parent, etc.), and the printed image 60 can be produced in accordance with the desired design. For instance, in some embodiments, the goalkeeper or another person may convey a request for the outer cover 42 to have the desired design to a provider of the outer cover 42 (e.g., a manufacturer of the leg pad $\mathbf{12}_x$, a distributor of the leg pad $\mathbf{12}_x$, a retailer where the leg pad $\mathbf{12}_x$ is purchasable, etc.). This request may be conveyed in any suitable manner, including in person or via a communication link that may be implemented by one or more of a data network (e.g., the Internet), a public telephony network (e.g., the Public Switched Telephone Network (PSTN)), and/or a wireless network (e.g., a cellular network), such as by telephone or by using a computer system (e.g., an online process implemented over the Internet).

Based on this request, the provider of the outer cover 42 causes the covering 47, including the printed image 60, to be made. For instance, in some examples of implementation, the provider of the outer cover 42 may interact with the image data provision entity 120 of the computing apparatus 130 to generate the image data 110 such that the printed image 60 reflects the desired design conveyed by the request. In other examples of implementation, the computing apparatus 130 may execute an automated process (e.g., an online process implemented over the Internet) such that the image data provision entity 120 automatically generates the image data 110 based on the request and proceeds to transmit the image data 110 to the digital printer 90 for printing the printed image 60 in accordance with the desired design conveyed by the request.

In other embodiments, other components of the leg pad $\mathbf{12}_x$ may be constructed using principles described above in respect of the outer cover 42. For instance, in some embodiments, the inner cover 44 may include a printed image such as the printed image 60 in order to decorate the inner surface 45 of the leg pad $\mathbf{12}_x$.

Although in embodiments considered above the leg pads $\mathbf{12}_1$, $\mathbf{12}_2$ are designed for playing ice hockey, in other embodiments, leg pads constructed using principles described herein in respect of the leg pads $\mathbf{12}_1$, $\mathbf{12}_2$ can be hockey goalkeeper leg pads for playing roller hockey or another type of hockey (e.g., field or street hockey) on a dry playing surface (e.g., a polymeric, concrete, wooden, or turf playing surface or any other dry playing surface on which roller hockey or field or street hockey is played).

While in this embodiment the protective athletic equipment 10 comprises the leg pads $\mathbf{12}_1$, $\mathbf{12}_2$, in other embodiments, other articles of protective athletic equipment may be constructed using principles described herein in respect of the leg pads $\mathbf{12}_1$, $\mathbf{12}_2$ to include a printed image such as the printed image 60.

Figure 20:
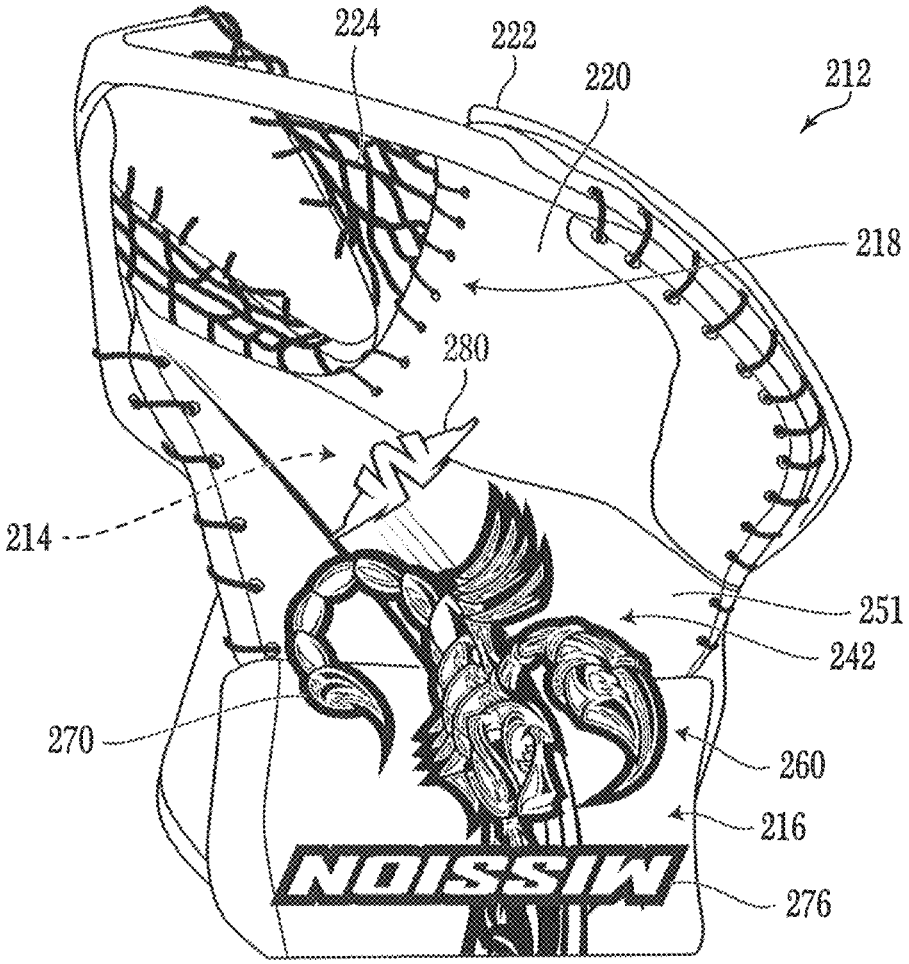
FIG. 20 shows an example of a catching glove comprising an outer cover that comprises a printed image in accordance with another embodiment of the invention.

For example, in some embodiments, as shown in FIG. 20, a protective glove 212 may be constructed using principles described herein in respect of the leg pads $\mathbf{12}_1$, $\mathbf{12}_2$. In this embodiment, the protective glove 212 is a catching glove, commonly referred to as a "catcher", for protecting a hand of a hockey goalkeeper and configured to catch a puck or ball while playing hockey. The catcher 212 includes a palm side 220 and a dorsal side 222, and comprises a hand-receiving cavity 214 to receive the goalkeeper's hand, a cuff portion 216 for overlying a wrist and/or forearm of the goalkeeper, and a catching portion 218 to catch the puck or ball. The catching portion 218 includes netting 224.

Figure 21:
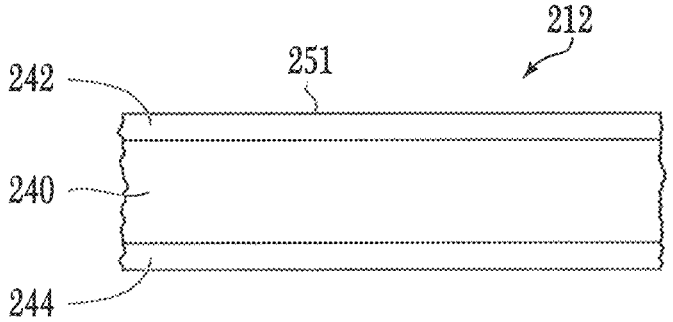
FIG. 21 shows a cross-sectional view of part of the catching glove.

With additional reference to FIG. 21, in this embodiment, the catcher 212 comprises an outer cover 242, an inner cover 244, and protective padding 240 disposed between the outer cover 242 and the inner cover 244. The outer cover 242 is a printed outer cover, i.e., comprises a printed image 260 on its outer surface 251. More specifically, the outer cover 242 includes a covering constructed in a similar manner to the covering 47 of the leg pad $\mathbf{12}_x$ described above. The covering comprises a printed layer and a transparent protective layer over the printed layer. The printed layer includes the printed image 260 which is printed on synthetic material of the printed layer in a similar manner to that described above.

Figure 22:
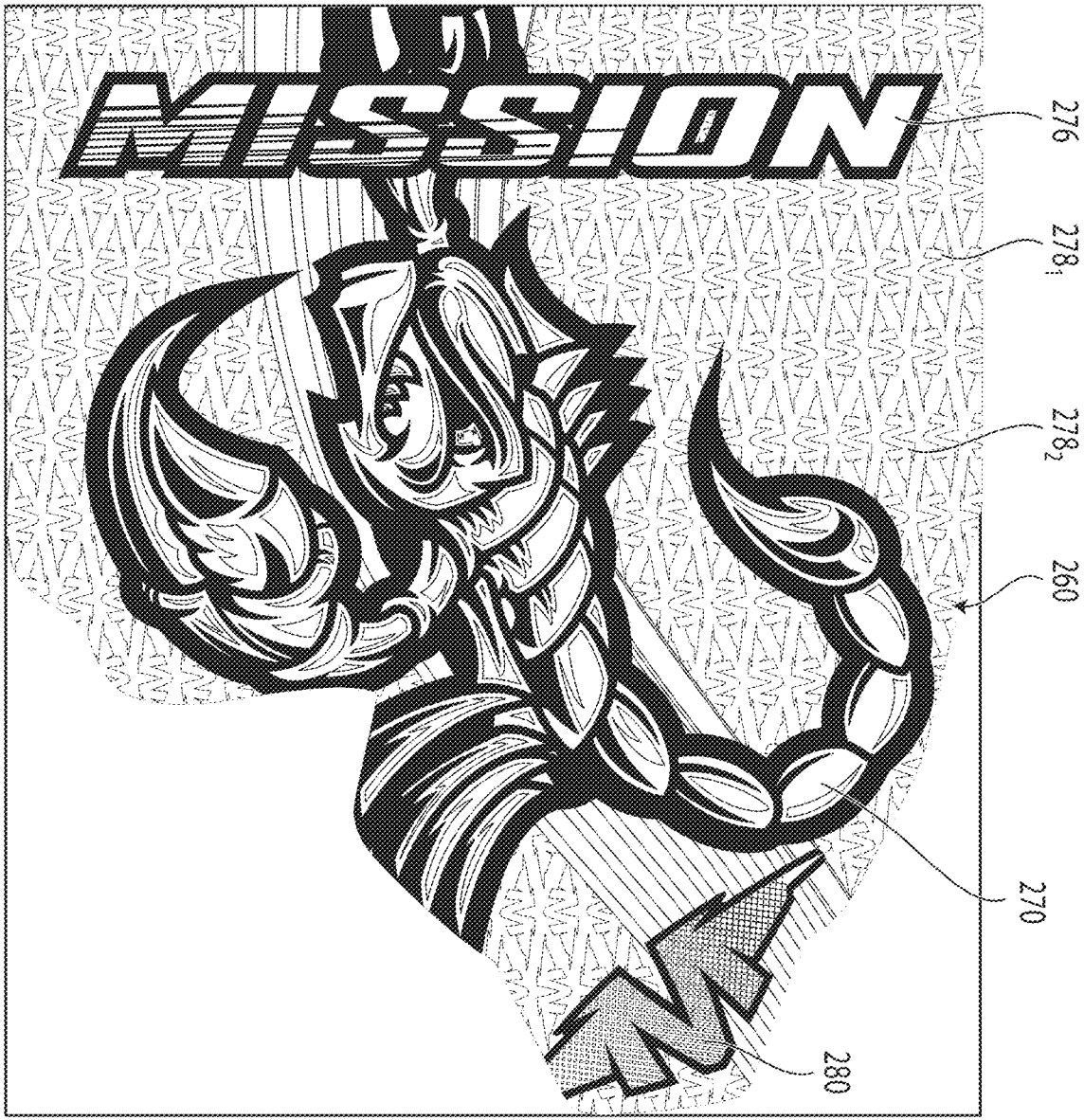
FIG. 22 shows a sheet to make the outer cover including the printed image of the catching glove of FIG. 20.

In this example, with additional reference to FIG. 22 which shows a template of the printed layer of the outer cover 242, the printed image 260 includes a graphical representation of a scorpion 270, a word 276 ("Mission"), a background made of an array of logos $\mathbf{278}_1$-$\mathbf{278}_L$ (i.e., stylized "M"s), and a larger version of the logo 280. In this embodiment, the covering includes a single covering piece extending on the frontal side of the catcher 212. Moreover, a print area of the printed image 260 occupies an entirety of the frontal side 220 of the catcher 212. In some case, the dorsal side 222 of the catcher 212 may similarly comprise a covering including a printed image.

Figure 23:
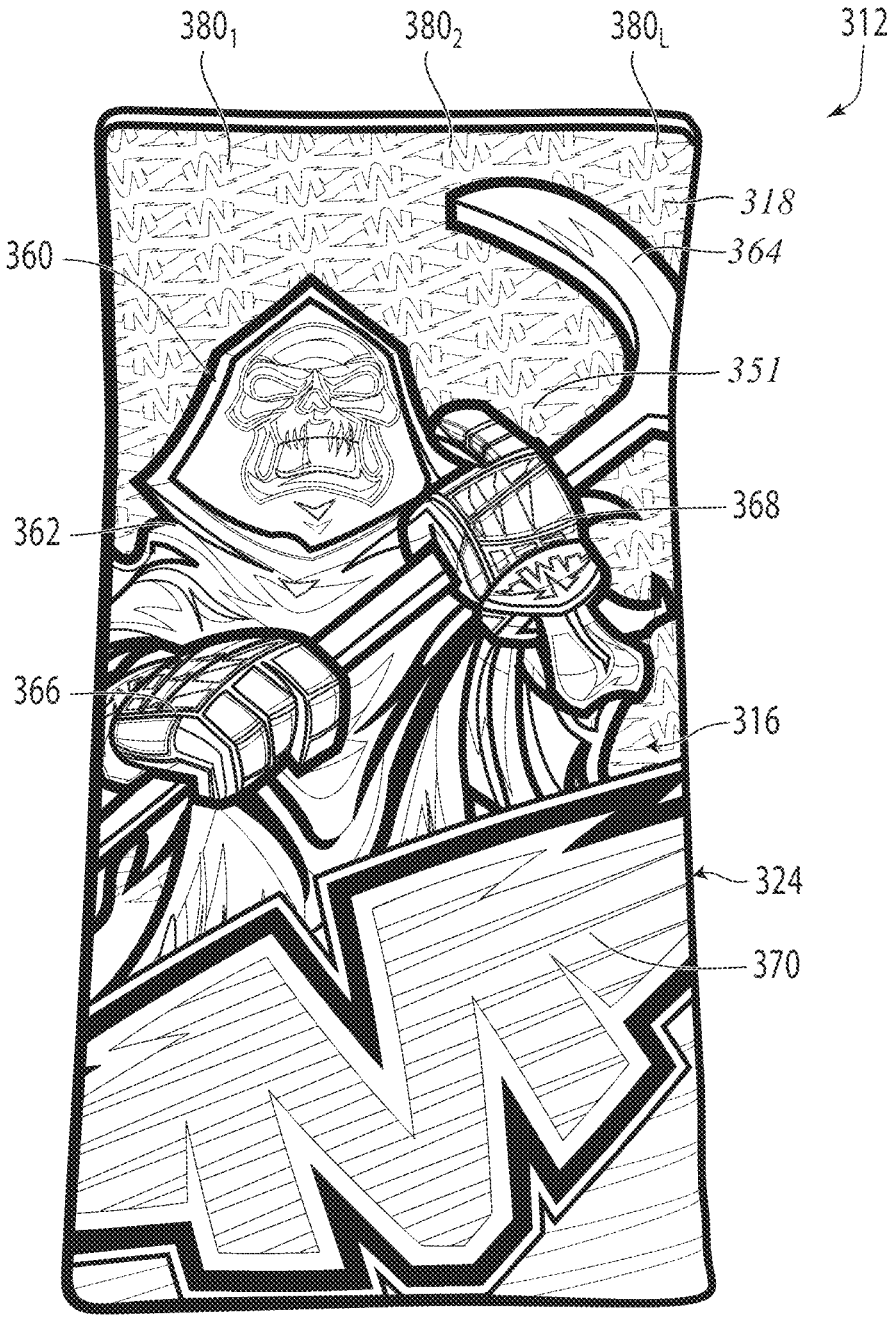
FIGS. 23 to 25 show an example of a blocking glove comprising an outer cover that comprises a printed image in accordance with another embodiment of the invention.
Figure 24:
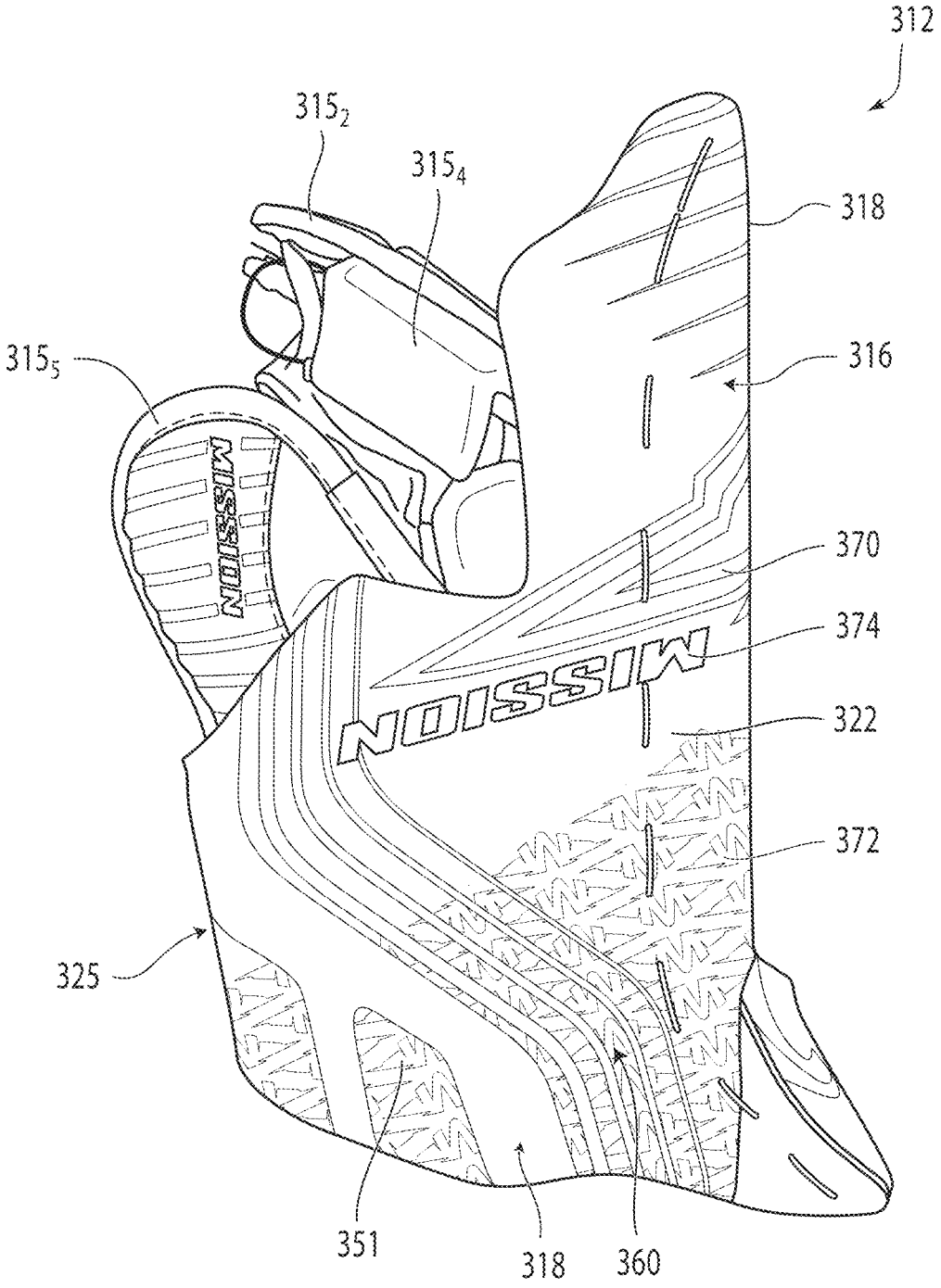
Figure 25:
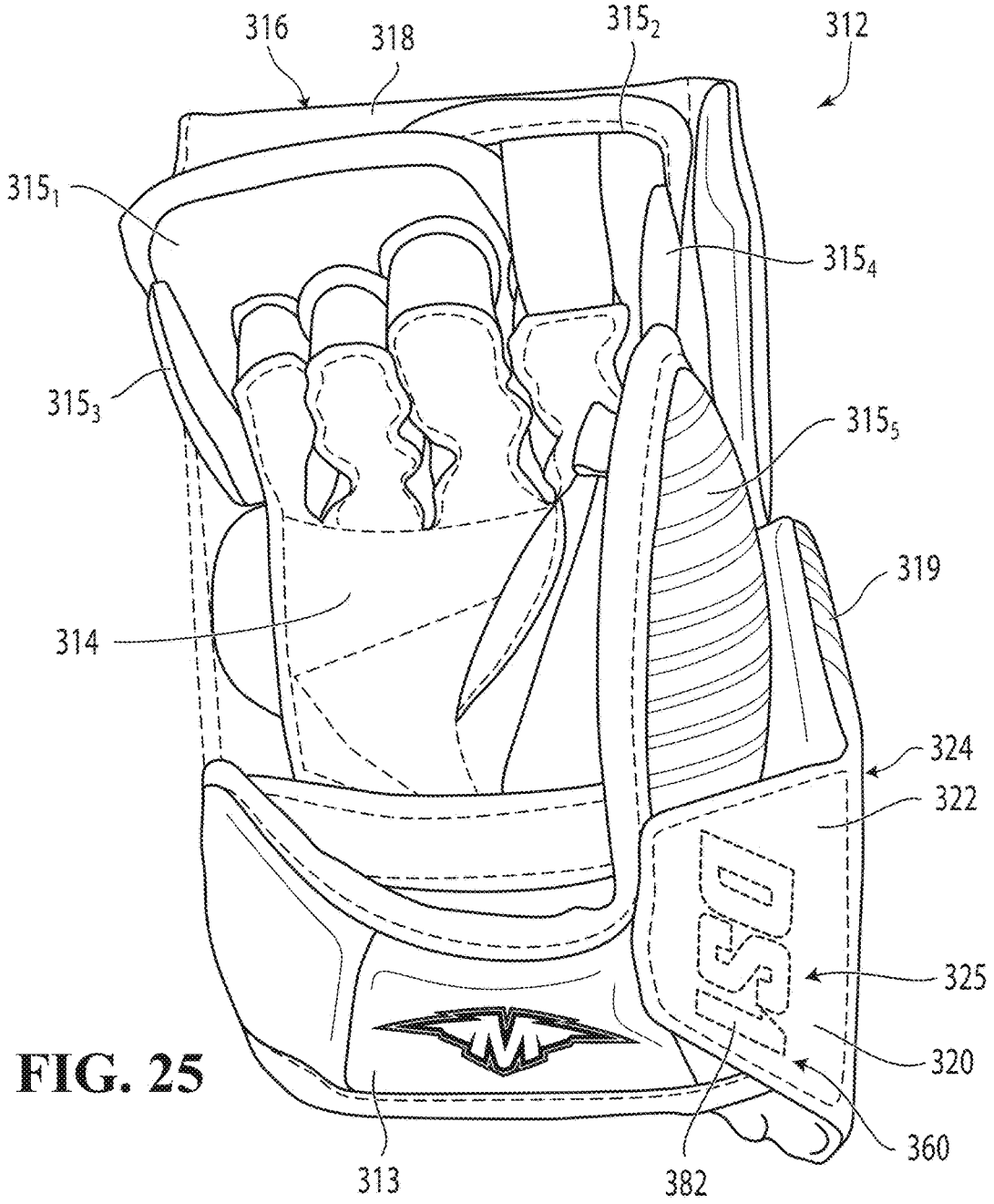

As another example, in some embodiments, with additional reference to FIGS. 23 to 25, a different type of protective glove 312 may be constructed using principles described herein in respect of the leg pads $\mathbf{12}_1$, $\mathbf{12}_2$. In this embodiment, the protective glove 312 is a blocking glove for a hockey goalkeeper, commonly referred to as a "blocker", and is configured to block a puck or ball. The blocker 312 comprises a hand-receiving portion 314 to receive the goalkeeper's hand, a cuff portion 313 for overlying the goalkeeper's wrist and/or forearm, protective elements $\mathbf{315}_1$-$\mathbf{315}_5$ (e.g., panels) to protect the goalkeeper's fingers, and a blocking portion 316 to block the puck or ball. The blocking portion 316 comprises a dorsal section 318, a medial section 319 and a frontal section 320 which form respective parts of an outer surface 322 of the blocking portion 316. The dorsal section 318 is located on a dorsal side 323 of the blocker 312 and is the section of the blocking portion 316 that is primarily used for blocking the puck or ball. The medial and frontal sections 319, 320 are located on medial and frontal sides 324, 325 of the blocker 312 respectively and are primarily used to protect the hand-receiving portion 314 against impacts.

Figure 26:
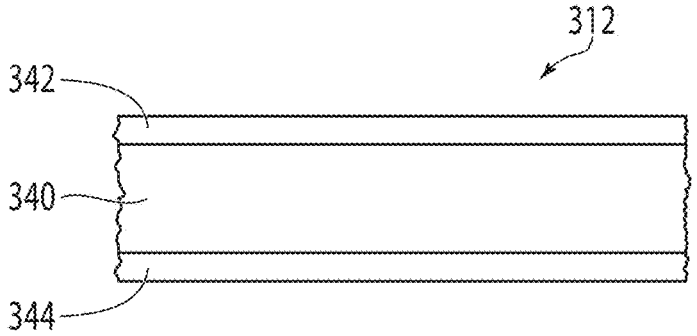
FIG. 26 shows a cross-sectional view of part of the blocking glove.

With additional reference to FIG. 26, in this embodiment, the blocking portion 316 of the blocker 312 comprises an outer cover 342, an inner cover 344, and protective padding 340 disposed between the outer cover 342 and the inner cover 344. The medial and frontal sections 319, 320 of the blocking portion 316 may comprise a thinner section of the protective padding 340 since they are not principally used to block the puck or ball. The outer cover 342 is a printed outer cover, i.e., comprises a printed image 360. More specifically, the outer cover 342 includes a covering constructed in a similar manner to the covering 47 of the leg pad $\mathbf{12}_x$ described above. The covering comprises a printed layer and a transparent protective layer over the printed layer. The printed layer includes the printed image 360 which is printed on synthetic material of the printed layer in a similar manner to that described above.

In this embodiment, the printed image 360 includes a graphical representation of the Grim Reaper 362, its scythe 364, protective gloves 366, 368, a logo 370 (i.e., a stylized "M'), a word 274 (i.e., "Mission") a background made of an array of logos $\mathbf{380}_1$-$\mathbf{380}_L$ (i.e., stylized "M"s), and a model name 382 (e.g., "DS1") of the blocker 312. In this example of implementation, a print area of the printed image 360 occupies an entirety of the dorsal, medial and frontal sides of the blocking portion 316.

As yet another example, in other embodiments, various other articles of protective athletic equipment such as shoulder pads, chest protectors, arm pads (e.g., elbow pads), shin guards, and protective gloves for hockey goalkeepers and other hockey players (i.e., forwards and defensemen) may be constructed using principles described herein in respect of the leg pads $12_1$, $12_2$ to include a printed image such as the printed image 60.

Figure 27:
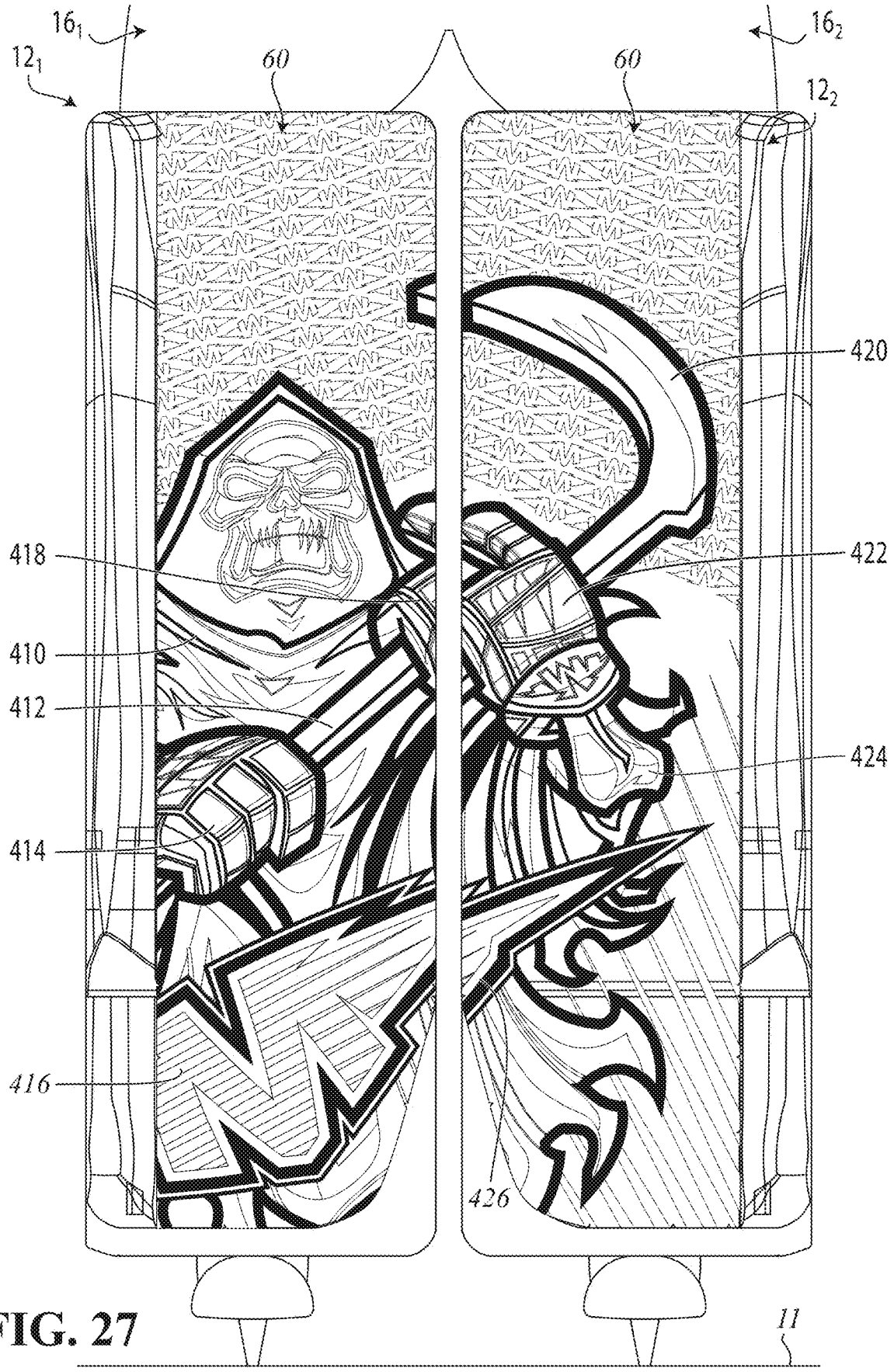
FIG. 27 shows an example of leg pads in accordance with another embodiment of the invention, wherein printed images of outer covers of the leg pads constitute a visual continuation of one another.

In some embodiments, the printed image of a given article of the protective athletic equipment 10 may be visually combinable with the printed image of an adjacent article of the protective athletic equipment 10 such that these printed images form a visual continuation of one another. For example, FIG. 27 shows an example of an embodiment in which in which the printed image 60 of the leg pad $12_1$ and the printed image 60 of the leg pad $12_2$ form a visual combination of one another. The printed image 60 of the leg pad $12_1$ includes a graphical representation of a head and torso of the Grim Reaper 410, part of its scythe 412, a first protective glove 414, part of a second protective glove 418, part of a logo 416 (i.e., a stylized "M'), while the printed image 60 of the leg pad $12_2$ includes a graphical representation of an arm the Grim Reaper 424, another part of its scythe 420, another part of the second protective glove 422, and another part of the logo 426. When the leg pads $12_1$, $12_2$ are positioned adjacent to one another, the printed image 60 of the leg pad $12_1$ and the printed image 60 of the leg pad $12_2$ form a visual continuation of one another.

Figure 28:
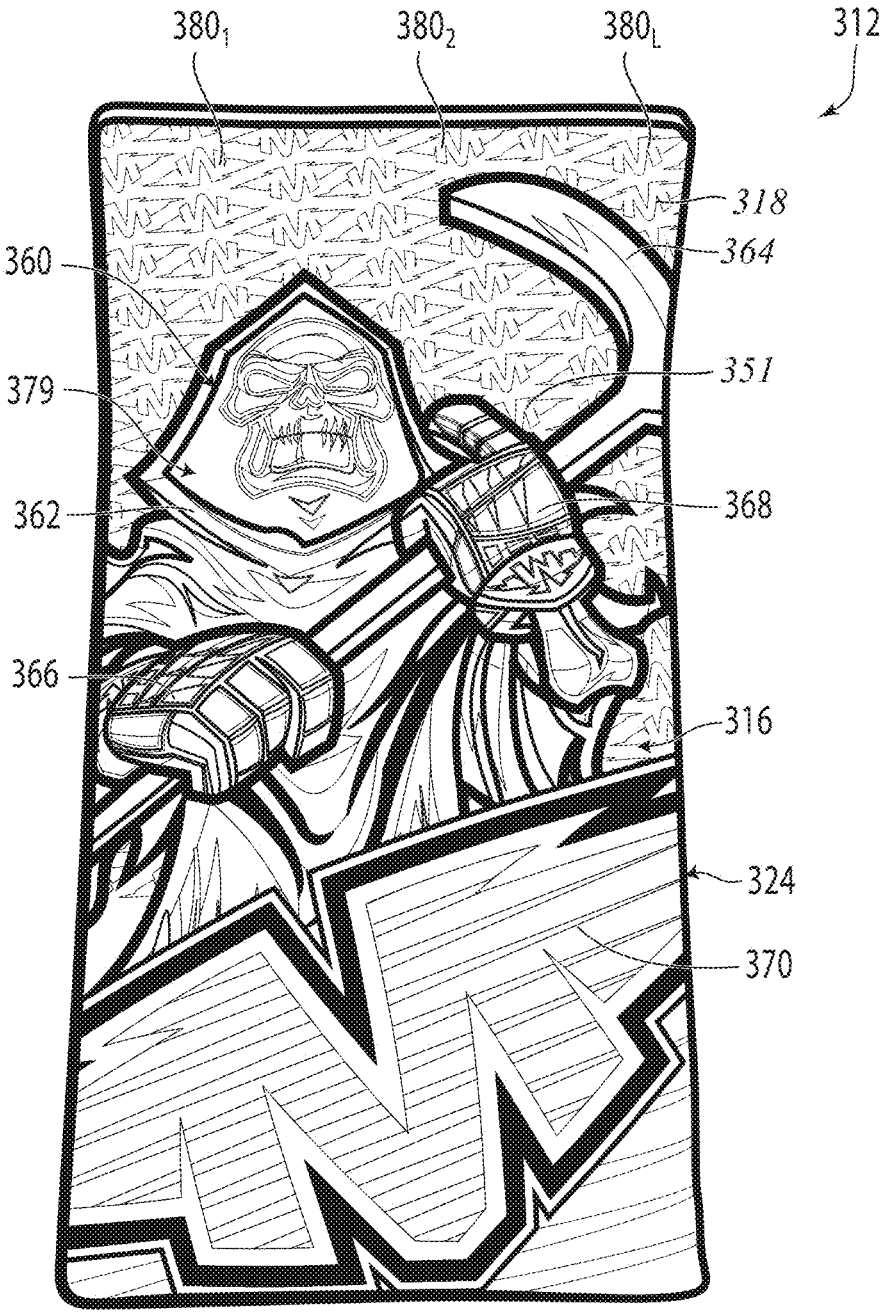
FIGS. 28 and 29 show an example of a variant of the blocking glove which comprises a graphical element separate from the printed image and visually integrated with the printed image.
Figure 29:
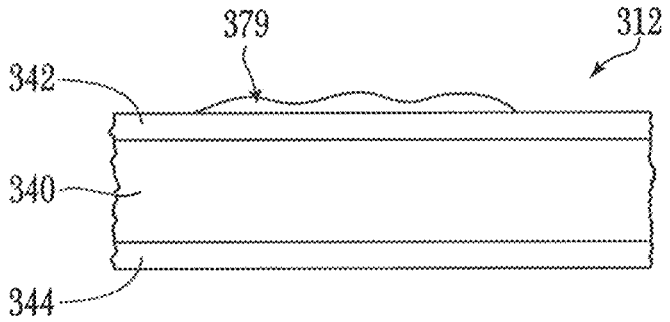
Figure 30:
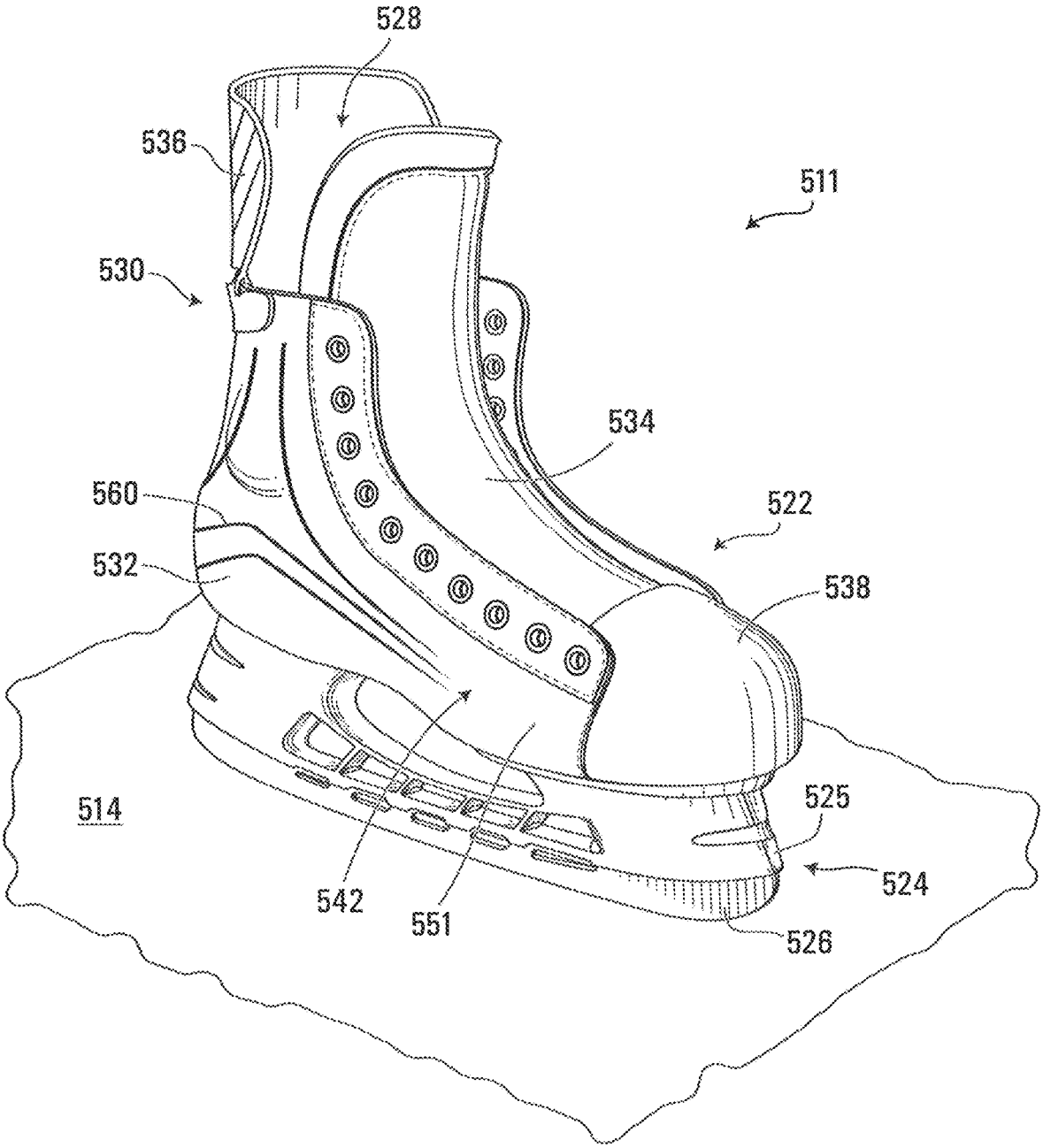
FIGS. 30 to 36 show an example of a skate comprising a printed outer cover in accordance with another embodiment of the invention.
Figure 31:
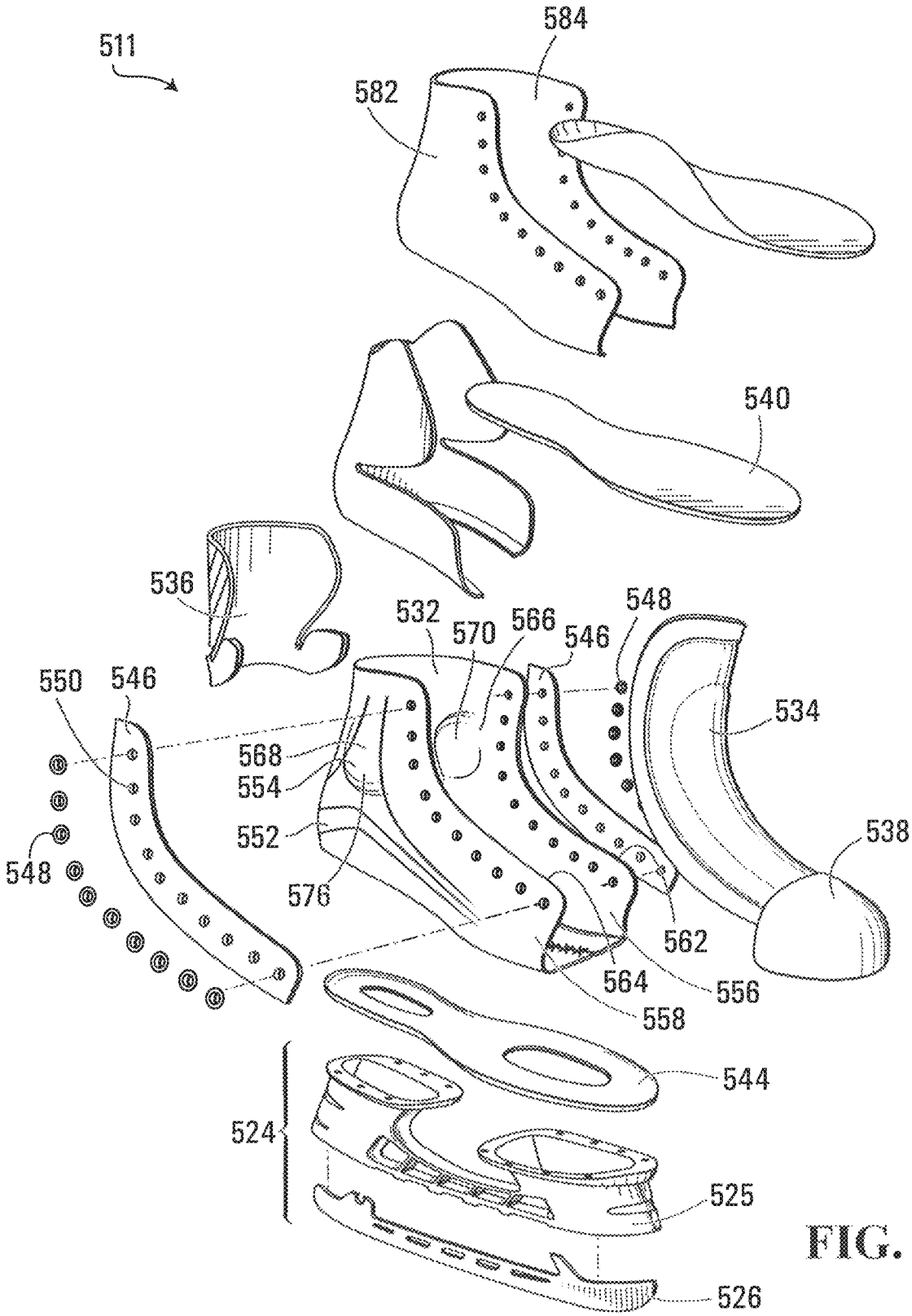
Figure 32:
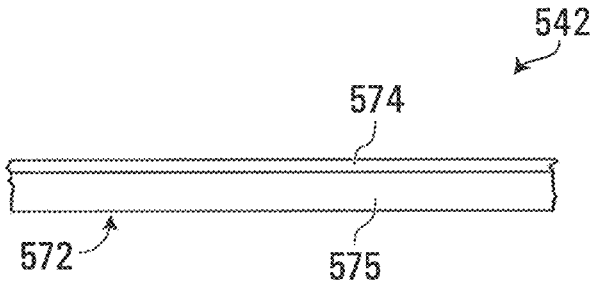
Figure 33:
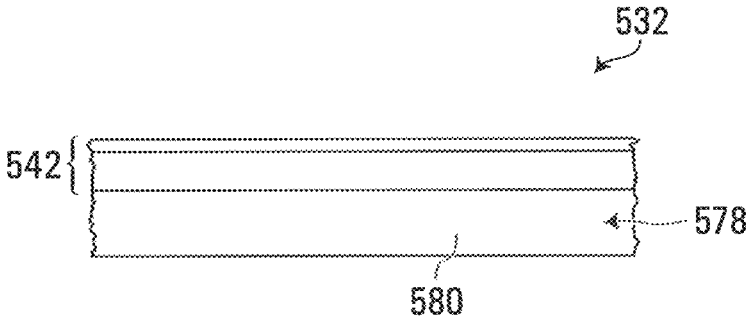
Figure 34:
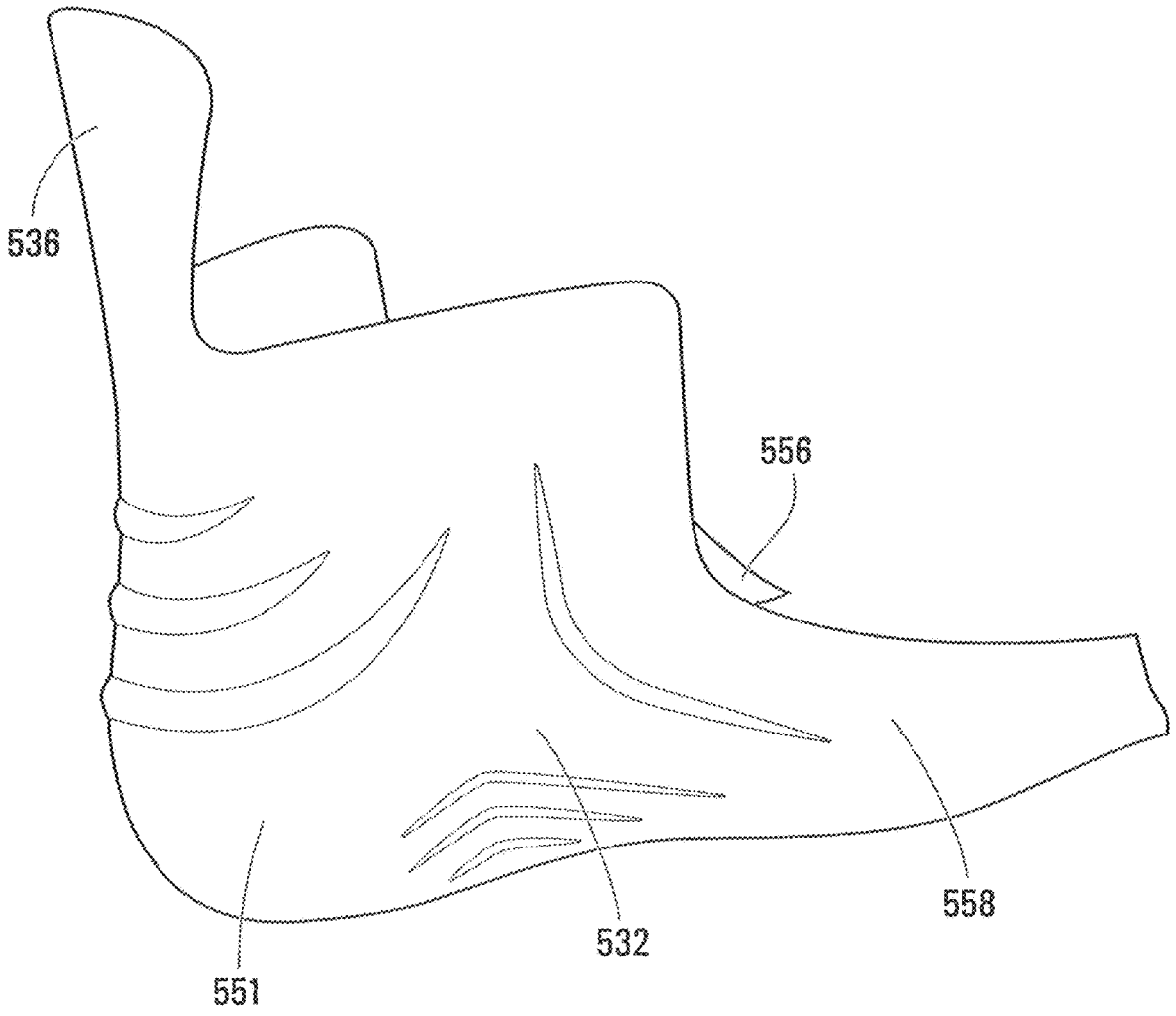
Figure 35:
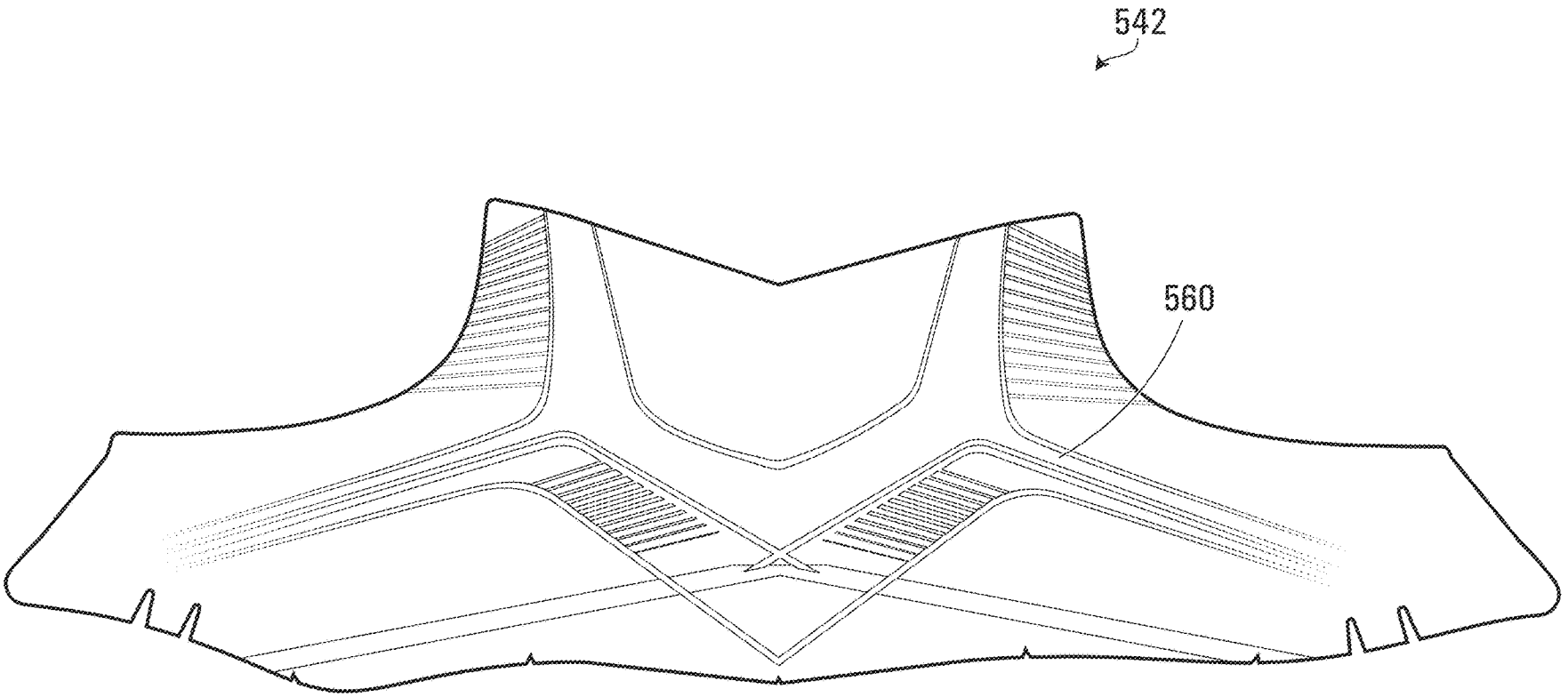
Figure 36:
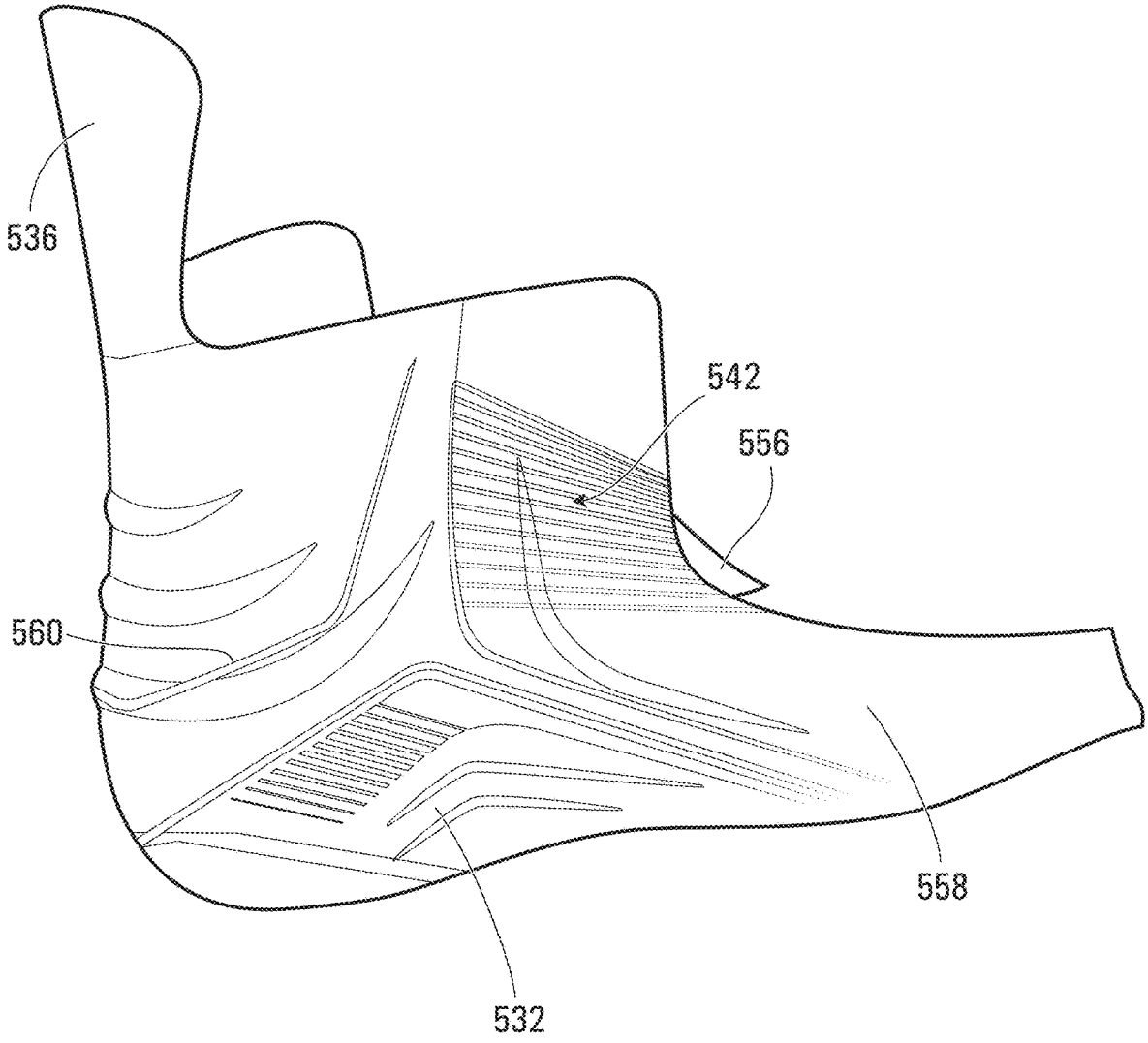

In some embodiments, an outer cover of an article of protective athletic equipment comprising a printed image as described above may also include one or more graphical elements that are provided separately from the printed image and visually integrated with the printed image. For example, FIGS. 28 and 29 show a variant of the blocker 312 which comprises a graphical element 379 that forms the head of the Grim Reaper so as to be visually integrated with the printed image 360. In this embodiment, the graphical element 379 is an overlay that is affixed (e.g., adhesively bonded) to the covering of the outer cover 342. The graphical element 379 is molded into shape and has a three-dimensional configuration so as to protrude slightly from the outer surface 322 of the blocking portion 316 for effect. In this case, the graphical element 379 is made of polyurethane. In other embodiments, the graphical element 379 may made of any other suitable material and/or using any other suitable process, and/or may be affixed relative to the printed image 360 in any other suitable way.

Although in this embodiment the protective athletic equipment 10 is hockey gear, in other embodiments, the protective athletic equipment 10 may be other athletic gear wearable a player playing another type of contact sport (e.g., a "full-contact" sport) in which there are significant impact forces on the player due to player-to-player and/or player-to-object contact. For example, in other embodiments, the protective athletic equipment 10 may be lacrosse gear for a lacrosse player, football gear for a football player, or baseball gear for a baseball player.

While in embodiments considered above the protective athletic equipment 10 is for a user playing a contact sport, in other embodiments, the protective athletic equipment 10 may be used in athletic activities other than contact sports in which impact protection is desired.

In other embodiments, the athletic gear 10 comprising an outer cover that includes a printed image as described above may be for purposes other than protection. For example, in some embodiments, with reference to FIGS. 30 to 36, the athletic gear 10 may comprise footwear 511 wearable on a user's foot. In this embodiment, the footwear 511 is a skate wearable by the user for skating on a skating surface 514. The skate 511 comprises a skate boot 522 for receiving a foot of the user and a skating device 524 below the skate boot 522 to contact the skating surface 514. More particularly, in this embodiment, the skating surface 514 is ice, the skate 511 is an ice skate, and the skating device 524 comprises a blade 526 for contacting the ice 514 and a blade holder 525 between the skate boot 522 and the blade 526. Notably, in this example, the ice skate 511 is a hockey skate designed for playing ice hockey and the user is a hockey player. In other examples, the ice skate 511 may be designed for other types of skating activities.

The skate boot 522 defines a cavity 528 for receiving the player's foot. More particularly, in this embodiment, the skate boot 522 comprises an upper 530 that forms the cavity 528 and comprises an outer cover 542 which is a printed outer cover, i.e., comprises a printed image 560 on its outer surface 551. More specifically, in this embodiment, the outer cover 542 is constructed in a similar manner to the covering 47 of the leg pad $12_x$ described above. Notably, in this example, the outer cover 542 comprises a printed layer 572 and a transparent protective layer 574 over the printed layer 572. The printed layer 572 includes the printed image 560 which is printed on synthetic material 575 (e.g., polyurethane, nylon, polyester, vinyl, composite, etc.) of the printed layer 572 in a similar manner to that described above.

More particularly. in this embodiment, the upper 530 comprises a shell 532, a tongue 534, a tendon guard 536, and a toe cap 538. The skate boot 522 also comprises an insole 540, an outsole 544, lace members 546 and eyelets 548 extending through (e.g., punched into) the lace members 546, the shell 532 and an inner liner vis-à-vis apertures 550 in order to receive laces for tying on the skate 511. In some embodiments, the skate boot 522 may also comprise a rigid insert for providing more rigidity around the ankle and the heel of the skater's foot, and a footbed for enhancing a fit of the skate 511 on the skater's foot.

The shell 532 imparts strength to the skate 511 to support the player's foot. More particularly, in this embodiment, the shell 532 comprises a heel portion 552 for receiving a heel of the player, an ankle portion 554 for receiving an ankle of the player, and medial and lateral side portions 556, 558 for facing medial and lateral sides of the player's foot, respectively. The medial and lateral side portions 556, 558 include upper edges 562, 564 which connect to the lace members 546. The heel portion 552 may be formed such that it is substantially cup-shaped for following the contour of the heel of the player. The ankle portion 554 comprises medial and lateral ankle sides 566, 568. The medial ankle side 566 has a medial depression 570 for receiving a medial malleolus of the player and the lateral ankle side 568 has a lateral depression 576 for receiving a lateral malleolus of the player. The lateral depression 576 is located slightly lower than the medial depression 570 for conforming to the morphology of the player's foot.

In this embodiment, the shell 532 comprises the printed outer cover 542. The shell 532 also comprises a core 578 beneath the outer cover 542. The core 578 comprises a synthetic material 580 that makes up a substantial part of the shell 532. In this embodiment, the synthetic material 580 is a polymeric material. For instance, in some examples of implementation, the polymeric material 580 may include a thermoplastic polymer. For example, in some embodiments, the polymeric material 580 may include polyurethane, nylon, polyester, polyethylene, vinyl, or any other suitable polymer. In some cases, the polymeric material 580 may be a polymer-matrix composite material (e.g., in which fibers are embedded in a polymer matrix). For instance, in some cases, the fibers may be carbon fibers, aramid fibers, or any other suitable fiber. In some cases, the polymeric material 580 may be a foam. The synthetic material 580 of the core 578 of the shell 532 may be implemented in any other suitable way in other embodiments (e.g., other types of composite material).

In this embodiment, the polymeric material 580 of the shell 532 constitutes at least part of the heel portion 552, the ankle portion 554, and the medial and lateral side portions 556, 558 of the shell 532. In some examples, the polymeric material 580 of the shell 532 may constitute at least a majority (i.e., a majority or an entirety) of the heel portion 552, the ankle portion 554, and the medial and lateral side portions 556, 558 of the shell 532. In some embodiments, the polymeric material 580 of the shell 532 may constitute a given part of the shell 532, while the shell 532 may comprise one or more other synthetic materials, different from the polymeric material 580, that constitute one or more other parts of the shell 532.

In this example of implementation, the polymeric material 580 of the shell 532 is molded material. That is, the polymeric material 580 of the shell 532 is formed by a molding process in a mold. A shape of the polymeric material 580 of the shell 532 is thus a molded shape imparted during the molding process. More particularly, in this example of implementation, the polymeric material 580 of the shell 532 is thermoformed material.

In this embodiment, the shell 532 also comprises an inner cover 582, which may also be referred to an "inner liner". The polymeric material 580 of the shell 532 is disposed between the outer cover 542 and the inner liner 582. The inner liner 582 is affixed to an inner surface of the polymeric material 580 of the shell 532 and comprises an inner surface 584 to contact with the heel and medial and lateral sides of the user's foot in use. In some cases, the inner liner 582 may be made of a soft material (e.g., a fabric made of nylon fibers or any other suitable fabric).

The printed outer cover 542 of the shell 532 may be provided in any suitable way, such as that discussed above in relation to the printed outer cover 42 of the leg pad $\mathbf{12}_x$.

For example, in some embodiments, the printed outer cover 542 may be created by digitally printing the printed image 560 on the synthetic material 575 of the printed layer 572 in a similar manner to that described above. Once the printed image 560 is created on the synthetic material 575, the transparent protective layer 574 may be laminated onto the printed layer 572. A sheet including the printed layer 572 and the transparent protective layer 574 may be cut into a desired shape to cover the shell 532.

In some embodiments, the sheet including the printed layer 572 and the transparent protective layer 574 may be positioned in the mold in which the shell 532 is to be formed. The polymeric material 580 destined to form the shell 532 may then be provided (e.g., injected) into the mold, against the sheet including the printed layer 572 and the transparent protective layer 574. The polymeric material 580 is then molded in the mold, with the sheet including the printed layer 572 and the transparent protective layer 574 being applied and bonded to an outer surface of the shell 532 as it is formed, thus forming the printed outer cover 562 of the shell 532. In some cases, the transparent protective layer 574 may help to protect the printed image 560 against deterioration from heat in the mold.

Alternatively, in some embodiments, the sheet including the printed layer 572 and the transparent protective layer 574 may be applied and affixed (e.g., adhesively bonded) to the outer surface of the shell 532 after the polymeric material 580 of the shell 532 has been molded in the mold and the shell 532 has been removed from the mold.

While in this embodiment the printed outer cover 542 is part of the shell 532 of the upper 530 of the skate boot 522, in other embodiments, a printed cover such as the printed outer cover 542 may be part of another component of the skate 511. For example, in other embodiments, a printed cover such as the printed outer cover 542 may be part of another component of the upper 530, such as the inner liner 582, the tongue 534, the tendon guard 536, or the toe cap 538. As another example, in other embodiments, a printed cover such as the printed outer cover 542 may be part of the blade holder 525 of the skate 511.

Although in embodiments considered above the skate 511 is designed for playing ice hockey on the playing surface 514 which is ice, in other embodiments, the skate 511 may be constructed using principles described herein for playing roller hockey or another type of hockey (e.g., field or street hockey) on the playing surface 314 which is a dry playing surface (e.g., a polymeric, concrete, wooden, or turf playing surface or any other dry playing surface on which roller hockey or field or street hockey is played). Thus, in other embodiments, instead of comprising the blade 526, the skating device 524 may comprise a set of wheels to roll on the dry playing surface 314.

Figure 37:
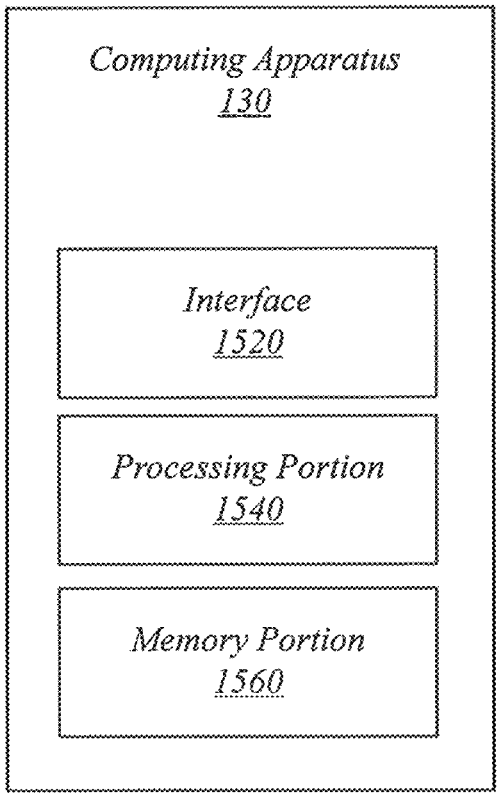
FIG. 37 shows an example of the computing apparatus.
Figure 38:
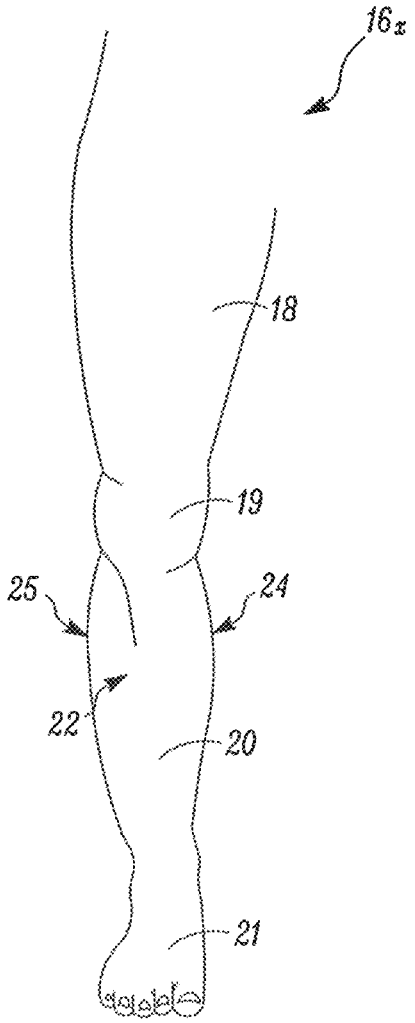
FIGS. 38 and 39 show front and side views of a leg of the hockey goalkeeper.
Figure 39:
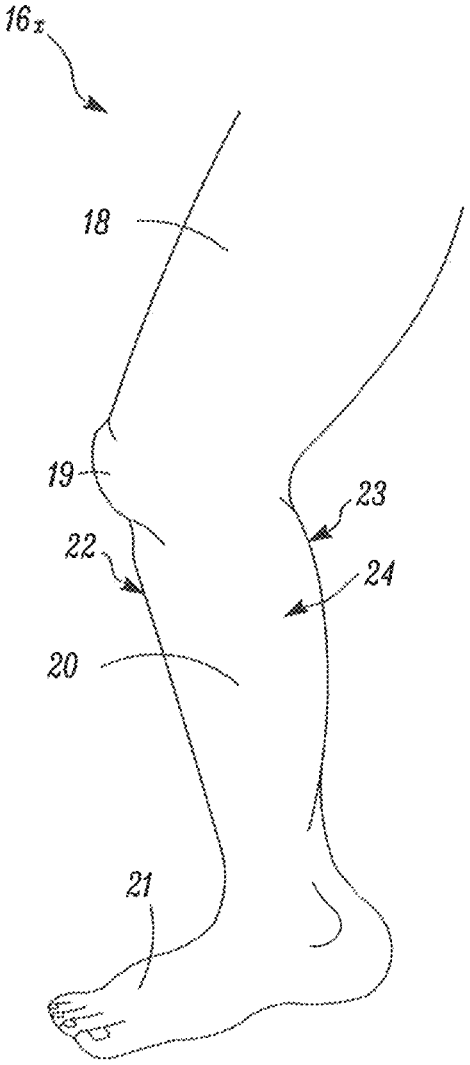

In some embodiments, as shown in FIG. 37, the computing apparatus 130, including the image data provision entity 120, comprises suitable hardware and/or software configured to implement functionality of the computing apparatus 130. The computing apparatus 130 comprises an interface 1520, a processing portion 1540, and a memory portion 1560.

The interface 1520 comprises one or more inputs and outputs allowing the computing apparatus 130 to receive signals from and send signals to other components to which the computing apparatus 130 is connected (i.e., directly or indirectly connected).

The processing portion 1540 comprises one or more processors for performing processing operations that implement functionality of the computing apparatus 130. A processor of the processing portion 1540 may be a general-purpose processor executing program code stored in the memory portion 1560. Alternatively, a processor of the processing portion 1540 may be a specific-purpose processor comprising one or more preprogrammed hardware or firmware elements (e.g., application-specific integrated circuits (ASICs), electrically erasable programmable read-only memories (EEPROMs), etc.) or other related elements.

The memory portion 1560 comprises one or more memories for storing program code executed by the processing portion 1540 and/or data used during operation of the processing portion 1540. A memory of the memory portion 1560 may be a semiconductor medium (including, e.g., a solid-state memory), a magnetic storage medium, an optical storage medium, and/or any other suitable type of memory. A memory of the memory portion 1560 may be read-only memory (ROM) and/or random-access memory (RAM), for example.

The computing apparatus 130 may be implemented in various other ways in other embodiments.

In some embodiments, two or more elements of the computing apparatus 130 may be implemented by devices that are physically distinct from one another (e.g., located in a common site or in remote sites) and may be connected to one another via a bus (e.g., one or more electrical conductors or any other suitable bus) or via a communication link which may be wired, wireless, or both and which may traverse one or more networks (e.g., the Internet or any other computer network such as a local-area network (LAN) or wide-area network (WAN), a cellular network, etc.). In other embodiments, two or more elements of the computing apparatus 130 may be implemented by a single device.

Any feature of any embodiment discussed herein may be combined with any feature of any other embodiment discussed herein in some examples of implementation.

Certain additional elements that may be needed for operation of certain embodiments have not been described or illustrated as they are assumed to be within the purview of those of ordinary skill in the art. Moreover, certain embodiments may be free of, may lack and/or may function without one or more elements that are not specifically disclosed herein.

Although various embodiments and examples have been presented, this was for the purpose of describing, but not limiting, the invention. Various modifications and enhancements will become apparent to those of ordinary skill in the art and are within the scope of the invention, which is defined by the appended claims.

The invention claimed is:

1. A goalkeeper leg pad for a hockey goalkeeper, the goalkeeper leg pad being wearable on a leg of the hockey goalkeeper to protect the leg of the hockey goalkeeper, the goalkeeper leg pad comprising an upper leg portion, a knee portion, a lower leg portion, and a foot portion, the foot portion of the goalkeeper leg pad extending transversally and forwardly relative to the lower leg portion of the goalkeeper leg pad and being configured to overlie a skate of the hockey goalkeeper, the goalkeeper leg pad comprising an outer surface defining a front of the goalkeeper leg pad, the outer surface of the goalkeeper leg pad comprising a main frontal face and an edge projection that is at a lateral edge of the goalkeeper leg pad, projects forwardly relative to the main frontal face of the goalkeeper leg pad and is elongated in a longitudinal direction of the goalkeeper leg pad, the main frontal face of the goalkeeper leg pad extending at the front of the goalkeeper leg pad from the upper leg portion of the goalkeeper leg pad to the foot portion of the goalkeeper leg pad in the longitudinal direction of the goalkeeper leg pad and from the edge projection at the lateral edge of the goalkeeper leg pad to a medial edge of the goalkeeper leg pad in a widthwise direction of the goalkeeper leg pad, the goalkeeper leg pad comprising:

a) protective padding configured to be wider that the leg of the hockey goalkeeper; and b) an outer cover disposed on the protective padding and constituting at least a majority of the outer surface of the goalkeeper leg pad, the outer cover comprising:

a digitally-printed layer including digitally-printed graphics; and a transparent protective layer over the digitally-printed layer;

the digitally-printed layer and the transparent protective layer extending in at least one of the upper leg portion, the knee portion, and the lower leg portion of the goalkeeper leg pad and in the foot portion of the goalkeeper leg pad, the digitally-printed layer and the transparent protective layer being continuous and exposed from the edge projection at the lateral edge of the goalkeeper leg pad to the medial edge of the goalkeeper leg pad in the widthwise direction of the goalkeeper leg pad.

2. An article of protective hockey-goalkeeping equipment wearable by a hockey goalkeeper to protect a given one of a leg of the hockey goalkeeper and a hand of the hockey goalkeeper, the article of protective hockey-goalkeeping equipment being one of: a goalkeeper leg pad wearable on and configured to protect the leg of the hockey goalkeeper, and a goalkeeper blocker or catcher wearable on and configured to protect the hand of the hockey goalkeeper, the article of protective hockey-goalkeeping equipment comprising an outer surface defining a front of the article of hockey-goalkeeping equipment, the article of protective hockey-goalkeeping equipment comprising:

a) protective padding configured to be wider than the given one of the leg of the hockey goalkeeper and the hand of the hockey goalkeeper; and b) an outer cover disposed on the protective padding and constituting at least a majority of the outer surface of the article of protective hockey-goalkeeping equipment, the outer cover comprising:

foam;

a digitally-printed layer comprising digitally-printed graphics and bonded to the foam at least one of adhesively and chemically; and a transparent protective layer over and thinner than the digitally-printed layer.

3. The article of protective hockey-goalkeeping equipment of claim 2, wherein a print area of the digitally-printed graphics occupies at least 30% of a surface area of the front of the article of protective hockey-goalkeeping equipment.

4. The article of protective hockey-goalkeeping equipment of claim 3, wherein the print area of the digitally-printed graphics occupies at least a majority of the surface area of the front of the article of protective hockey-goalkeeping equipment.

5. The article of protective hockey-goalkeeping equipment of claim 2, wherein a print area of the digitally-printed graphics occupies at least one-third of a length of the article of protective hockey-goalkeeping equipment.

6. The article of protective hockey-goalkeeping equipment of claim 5, wherein the print area of the digitally-printed graphics occupies at least a majority of the length of the article of protective hockey-goalkeeping equipment.

7. The article of protective hockey-goalkeeping equipment of claim 5, wherein the print area of the digitally-printed graphics occupies at least one-third of a width of the article of protective hockey-goalkeeping equipment.

8. The article of protective hockey-goalkeeping equipment of claim 6, wherein the print area of the digitally-printed graphics occupies at least a majority of a width of the article of protective hockey-goalkeeping equipment.

9. The article of protective hockey-goalkeeping equipment of claim 2, wherein the digitally-printed layer includes polyurethane.

10. The article of protective hockey-goalkeeping equipment of claim 2, wherein the protective layer includes polyurethane.

11. The article of protective hockey-goalkeeping equipment of claim 2, wherein the transparent protective layer is laminated onto the digitally-printed layer.

12. The article of protective hockey-goalkeeping equipment of claim 2, wherein the foam comprises molded foam defining a shape of the outer cover.

13. The article of protective hockey-goalkeeping equipment of claim 2, wherein the digitally-printed layer comprises a plurality of separate pieces which include respective portions of the digitally-printed graphics and which are assembled together and affixed to collectively visually compose the digitally-printed graphics.

14. The article of protective hockey-goalkeeping equipment of claim 2, wherein the digitally-printed layer is a one-piece layer which comprises an entirely of the digitally-printed graphics.

15. An article of protective hockey-goalkeeping equipment wearable by a hockey goalkeeper to protect a given one of a leg of the hockey goalkeeper and a hand of the hockey goalkeeper, the article of protective hockey-goalkeeping equipment being one of: a goalkeeper leg pad wearable on and configured to protect the leg of the hockey goalkeeper; and a goalkeeper blocker or catcher wearable on and configured to protect the hand of the hockey goalkeeper, the article of protective hockey-goalkeeping equipment comprising an outer surface defining a front of the article of hockey-goalkeeping equipment, the article of protective hockey-goalkeeping equipment comprising:

a. protective padding configured to be wider than the given one of the leg of the hockey goalkeeper and the hand of the hockey goalkeeper; and an outer cover disposed on the protective padding and constituting at least a majority of the outer surface of the article of protective hockey-goalkeeping equipment, the outer cover comprising:

a. foam;

b. digitally-printed layer comprising digitally-printed graphics and bonded to the foam at least one of adhesively and chemically; and c. a transparent protective layer over the digitally-printed layer; the digitally-printed layer and the transparent protective layer being continuous and exposed from a first edge of the article of protective hockey-goalkeeping equipment to a second edge of the article of protective hockey-goalkeeping equipment that is opposite to the first edge of the article of protective hockey-goalkeeping equipment in a widthwise direction of the article of protective hockey-goalkeeping equipment.

16. The goalkeeper leg pad of claim 1, wherein the digitally-printed graphics extend in at least one of the upper leg portion and the lower leg portion of the goalkeeper leg pad.

17. The goalkeeper leg pad of claim 1, wherein the digitally-printed graphics extend in the lower leg portion of the goalkeeper leg pad.

18. The goalkeeper leg pad of claim 17, wherein the digitally-printed graphics extend in the upper portion of the goalkeeper leg pad.

19. The goalkeeper leg pad of claim 1, wherein the digitally-printed graphics extend in the upper leg portion of the goalkeeper leg pad.

20. A goalkeeper leg pad for a hockey goalkeeper, the goalkeeper leg pad being wearable on a leg of the hockey goalkeeper to protect the leg of the hockey goalkeeper, the goalkeeper leg pad comprising an upper leg portion, a knee portion, a lower leg portion, and a foot portion, the foot portion of the goalkeeper leg pad extending transversally and forwardly relative to the lower leg portion of the goalkeeper leg pad and being configured to overlie a skate of the hockey goalkeeper, the goalkeeper leg pad comprising an outer surface defining a front of the goalkeeper leg pad, the outer surface of the goalkeeper leg pad comprising a main frontal face and an edge projection that is at a lateral edge of the goalkeeper leg pad, projects forwardly relative to the main frontal face of the goalkeeper leg pad and is elongated in a longitudinal direction of the goalkeeper leg pad, the main frontal face of the goalkeeper leg pad extending at the front of the goalkeeper leg pad from the upper leg portion of the goalkeeper leg pad to the foot portion of the goalkeeper leg pad in the longitudinal direction of the goalkeeper leg pad and from the edge projection at the lateral edge of the goalkeeper leg pad to a medial edge of the goalkeeper leg pad in a widthwise direction of the goalkeeper leg pad, the goalkeeper leg pad comprising:

a) an outer cover constituting at least a majority of the outer surface of the goalkeeper leg pad and comprising: foam;

a digitally-printed layer comprising digitally-printed graphics and bonded to the foam at least one of adhesively and chemically; and a transparent protective layer over and thinner than the digitally-printed layer;

the digitally-printed layer and the transparent protective layer being continuous and exposed from the edge projection at the lateral edge of the goalkeeper leg pad to the medial edge of the goalkeeper leg pad in the widthwise direction of the goalkeeper leg pad;

b) an inner cover;

c) protective padding disposed between the outer cover and the inner cover and configured to be wider than the leg of the hockey goalkeeper; and d) a lace lacing the protective padding and being unapparent at the front of the goalkeeper leg pad such that the goalkeeper leg pad is free of lacing extending through through the digitally-printed graphics and the transparent protective layer.

21. The article of protective hockey-goalkeeping equipment of claim 15, wherein the digitally-printer layer includes polyurethane.

22. The article of protective hockey-goalkeeping equipment of claim 15, wherein the transparent protective layer is thinner than the digitally-printer layer.

23. The article of protective hockey-goalkeeping equipment of claim 15, wherein the transparent protective layer is laminated onto the digitally-printer layer.

24. The article of protective hockey-goalkeeping equipment of claim 15, wherein the foam comprises molded foam defining a shape of the outer cover.

25. The article of protective hockey-goalkeeping equipment of claim 15, wherein the digitally-printed layer comprises a plurality of separate pieces which include respective portions of the digitally-printed graphics and which are assembled together and affixed on the foam to collectively visually compose the digitally-printed graphics.

26. The article of protective hockey-goalkeeping equipment of claim 15, wherein the digitally-printed layer is a one-piece layer which comprises an entirety of the digitally-printed graphics.

27. The article of protective hockey-goalkeeping equipment of claim 15, wherein a print area of the digitally-printed graphics occupies at least 30% of a surface area of the front of the article of protective hockey-goalkeeping equipment.

28. The article of protective hockey-goalkeeping equipment of claim 27, wherein the print area of the digitally-printed graphics occupies at least a majority of the surface area of the front of the article of protective hockey-goalkeeping equipment.

29. The article of protective hockey-goalkeeping equipment of claim 15, wherein a print area of the digitally-printed graphics occupies at least one-third of a length of the article of protective hockey-goalkeeping equipment.

30. The article of protective hockey-goalkeeping equipment of claim 29, wherein the print area of the digitally-printed graphics occupies at least a majority of the length of the article of protective hockey-goalkeeping equipment.

31. The article of protective hockey-goalkeeping equipment of claim 15, wherein the digitally-printed layer is adhesively bonded to the foam.

32. The article of protective hockey-goalkeeping equipment of claim 15, wherein the digitally-printed layer is chemically bonded to the foam.

33. The article of protective hockey-goalkeeping equipment of claim 15, wherein the foam is molded foam and the digitally-printed layer is bonded to the foam after molding of the molded foam.

34. A pair of goalkeeper leg pads for a hockey goalkeeper, the goalkeeper leg pads being wearable on legs of the hockey goalkeeper to protect the legs of the hockey goalkeeper, each goalkeeper leg pad comprising an upper leg portion, a knee portion, a lower leg portion, and a foot portion, the foot portion of the goalkeeper leg pad extending transversally and forwardly relative to the lower leg portion of the goalkeeper leg pad and being configured to overlie a skate of the hockey goalkeeper, the goalkeeper leg pad comprising an outer surface defining a front of the goalkeeper leg pad, the outer surface of the goalkeeper leg pad comprising a main frontal face and an edge projection that is at a lateral edge of the goalkeeper leg pad, projects forwardly relative to the main frontal face of the goalkeeper leg pad and is elongated in a longitudinal direction of the goalkeeper leg pad, the main frontal face of the goalkeeper leg pad extending at the front of the goalkeeper leg pad from the upper leg portion of the goalkeeper leg pad to the foot portion of the goalkeeper leg pad in the longitudinal direction of the goalkeeper leg pad and from the edge projection at the lateral edge of the goalkeeper leg pad to a medial edge of the goalkeeper leg pad in a widthwise direction of the goalkeeper leg pad, the goalkeeper leg pad comprising:

a) protective padding configured to be wider than the given one of the legs of the hockey goalkeeper protected by the goalkeeper leg pad; and b) an outer cover disposed on the protective padding, constituting at least a majority of the outer surface of the goalkeeper leg pad, and comprising:

a digitally-printed layer including digitally-printed graphics; and a transparent protective layer over the digitally-printed layer;

the digitally-printed layer and the transparent protective layer being continuous and exposed from the edge projection at the lateral edge of the goalkeeper leg pad to the medial edge of the goalkeeper leg pad in the widthwise direction of the goalkeeper leg pad;

wherein the digitally-printed graphics of a left one of the goalkeeper leg pads depict a left part of an object and the digitally-printed graphics of a right one of the goalkeeper leg pads depict a right part of the object that is visually combinable with the left part of the object to visually form the object.

35. The article of protective hockey-goalkeeping equipment of claim 2, wherein the outer surface of the article of protective hockey-goalkeeping equipment comprises three-dimensional formations integrated with the digitally-printed graphics.

36. The article of protective hockey-goalkeeping equipment of claim 35, wherein the three-dimensional formations comprise recesses.

37. The article of protective hockey-goalkeeping equipment of claim 36, wherein respective ones of the recesses are spaced from one another in a longitudinal direction of the article of protective hockey-goalkeeping equipment and a widthwise direction of the article of protective hockey-goalkeeping equipment.

38. The article of protective hockey-goalkeeping equipment of claim 36, wherein the recesses impart a texture of the outer cover such that the outer cover is textured.

39. The article of protective hockey-goalkeeping equipment of claim 2, comprising a lace lacing the protective padding and being unapparent at the front of the article of protective hockey-goalkeeping equipment such that the article of protective hockey-goalkeeping equipment is free of lacing extending through the outer cover.

40. The goalkeeper leg pad of claim 1, wherein the outer surface of the goalkeeper leg pad comprises recesses integrated with the digitally-printed graphics.

41. The goalkeeper leg pad of claim 40, wherein respective ones of the recesses are spaced from one another in the longitudinal direction of the goalkeeper leg pad and the widthwise direction of the goalkeeper leg pad.

42. The goalkeeper leg pad of claim 40, wherein the recesses impart a texture of the outer cover such that the outer cover is textured.

43. The goalkeeper leg pad of claim 1, comprising a lace lacing the protective padding and being unapparent at the front of the goalkeeper leg pad such that the goalkeeper leg pad is free of lacing extending through the outer cover.

44. The article of protective hockey-goalkeeping equipment of claim 15, wherein the outer surface of the goalkeeper leg pad comprises recesses integrated with the digitally-printed graphics.

45. The article of protective hockey-goalkeeping equipment of claim 44, wherein respective one of the recesses are spaced from one another in a longitudinal direction of the article of protective hockey-goalkeeping equipment and the widthwise direction of the article of protective hockey-goalkeeping equipment.

46. The article of protective hockey-goalkeeping equipment of claim 44, wherein the recesses impart a texture of the outer cover such that the outer cover is textured.

47. The article of protective hockey-goalkeeping equipment of claim 15, wherein the digitally-printed comprises fibers.

48. The article of protective hockey-goalkeeping equipment of claim 47, wherein the digitally-printed layer comprises polymeric material distinct from fibers.

49. The article of protective hockey-goalkeeping equipment of claim 47, wherein the fibers are microfibers.

50. The article of protective hockey-goalkeeping equipment of claim 15, comprising a lace lacing the protective padding and being unapparent at the front of the article of protective hockey-goalkeeping equipment such that the article of protective hockey-goalkeeping equipment is free of lacing extending through the outer cover.

51. The article of protective hockey-goalkeeping equipment of claim 15, wherein at least part of the foam, at least part of the digitally-printed graphics, and at least part of the transparent protective layer are bent in a longitudinal direction of the article of protective hockey-goalkeeping equipment.

52. The article of protective hockey-goalkeeping equipment of claim 2, wherein: the article of protective hockey-goalkeeping equipment is the goalkeeper leg pad; the goalkeeper leg pad comprises an upper leg portion, a knee portion, a lower leg portion, and a foot portion, the foot portion of the goalkeeper leg pad extending transversally and forwardly relative to the lower leg portion of the goalkeeper leg pad and is configured to overlie a skate of the hockey goalkeeper; the outer surface of the goalkeeper leg pad comprises a main frontal face and an edge projection that is at a lateral edge of the goalkeeper leg pad, projects forwardly relative to the main frontal face of the goalkeeper leg pad and is elongated in a longitudinal direction of the goalkeeper leg pad; the main frontal face of the goalkeeper leg pad extends at the front of the goalkeeper leg pad from the upper leg portion of the goalkeeper leg pad to the foot portion of the goalkeeper leg pad in the longitudinal direction of the goalkeeper leg pad and from the edge projection at the lateral edge of the goalkeeper leg pad to a medial edge of the goakeeper leg pad in a widthwise direction of the goalkeeper leg pad; and the digitally-printed layer and the transparent protective layer are continuous and exposed from the edge projection at the lateral edge of the goalkeeper leg pad to the medial edge of the goalkeeper leg pad in the widthwise direction of the goalkeeper leg pad.

53. The article of protective hockey-goalkeeping equipment of claim 15, wherein: the article of protective hockey-goalkeeping equipment is the goalkeeper leg pad; the first edge of the article of protective hockey-goalkeeping equipment is a lateral edge of the goalkeeper leg pad; the second edge of the article of protective hockey-goalkeeping equipment is a medial edge of the goalkeeper leg pad; the goalkeeper leg pad comprises an upper leg portion, a knee portion, a lower leg portion, and a foot portion, the foot portion of the goalkeeper leg pad extending transversally and forwardly relative to the lower leg portion of the goalkeeper leg pad and is configured to overlie a skate of the hockey goalkeeper; the outer surface of the goalkeeper leg pad comprises a main frontal face and an edge projection that is at the lateral edge of the goalkeeper leg pad, projects forwardly relative to the main frontal face of the goalkeeper leg pad and is elongated in a longitudinal direction of the goalkeeper leg pad; the main frontal face of the goalkeeper leg pad extends at the front of the goalkeeper leg pad from the upper leg portion of the goalkeeper leg pad to the foot portion of the goalkeeper leg pad in the longitudinal direction of the goalkeeper leg pad and from the edge projection at the lateral edge of the goalkeeper leg pad to the medial edge of the goalkeeper leg pad in the widthwise direction of the goalkeeper leg pad; and the digitally-printed layer and the transparent protective layer are continuous and exposed from the edge projection at the lateral edge of the goalkeeper leg pad to the medial edge of the goalkeeper leg pad in the widthwise direction of the goalkeeper leg pad.

54. The article of protective hockey-goalkeeping equipment of claim 51, wherein the at least part of the foam, the at least part of the digitally-printed graphics, and the at least part of the transparent protective layer are bent in the longitudinal direction of the article of protective hockey-goalkeeping equipment by being curved in the longitudinal direction of the article of protective hockey-goalkeeping equipment.

55. The article of protective hockey-goalkeeping equipment of claim 51, wherein the at least part of the foam, the at least part of the digitally-printed graphics, and the at least part of the transparent protective layer are bent in the longitudinal direction of the article of protective hockey-goalkeeping equipment by being angular in the longitudinal direction of the article of protective hockey-goalkeeping equipment.

56. The article of protective hockey-goalkeeping equipment of claim 51, wherein the at least part of the foam, the at least part of the digitally-printed graphics, and the at least part of the transparent protective layer are bent in the longitudinal direction of the article of protective hockey-goalkeeping equipment by being curved and angular in the longitudinal direction of the article of protective hockey-goalkeeping equipment.

* * * * *